US009095229B2

(12) United States Patent
Attree et al.

(10) Patent No.: US 9,095,229 B2
(45) Date of Patent: Aug. 4, 2015

(54) DISPENSER FOR CONTAINERS

(75) Inventors: Julian Attree, Georgetown (CA); Marinko Tepic, Georgetown (CA)

(73) Assignee: MINUS FORTY HOLDINGS CORP., Ontario (CA)

( * ) Notice: Subject to any disclaimer, the term of this patent is extended or adjusted under 35 U.S.C. 154(b) by 47 days.

(21) Appl. No.: 13/543,797

(22) Filed: Jul. 7, 2012

(65) Prior Publication Data

US 2013/0037500 A1 Feb. 14, 2013

Related U.S. Application Data

(60) Provisional application No. 61/505,761, filed on Jul. 8, 2011.

(51) Int. Cl.

| | |
|---|---|
| ***A47F 1/04*** | (2006.01) |
| ***A47F 1/12*** | (2006.01) |
| ***A47F 7/28*** | (2006.01) |

(52) U.S. Cl.

CPC ..... *A47F 1/126* (2013.01); *A47F 7/285* (2013.01)

(58) Field of Classification Search

CPC ..... A47F 1/04; A47F 1/12; A47F 1/125; A47F 1/126; A47F 7/285

USPC ..... 211/51, 59.2, 59.3, 74, 75

See application file for complete search history.

(56) References Cited

U.S. PATENT DOCUMENTS

| | | | | |
|---|---|---|---|---|
| 2,327,379 | A * | 8/1943 | Thomas | 211/74 |
| 2,600,096 | A * | 6/1952 | Cooper et al. | 211/41.2 |
| 2,703,253 | A * | 3/1955 | Biederman | 294/87.2 |
| 5,695,074 | A * | 12/1997 | Wiese | 211/59.2 |
| 5,695,075 | A * | 12/1997 | Flum et al. | 211/59.2 |
| 5,788,091 | A * | 8/1998 | Robertson et al. | 211/59.2 |
| 6,189,734 | B1 * | 2/2001 | Apps et al. | 221/193 |
| 6,360,901 | B1 * | 3/2002 | Parham | 211/59.2 |
| 6,523,719 | B2 * | 2/2003 | Trulaske, Sr. | 221/301 |
| 6,648,151 | B2 * | 11/2003 | Battaglia et al. | 211/59.2 |
| 2008/0203253 | A1 * | 8/2008 | Vogler | 248/220.31 |
| 2008/0283477 | A1 * | 11/2008 | Wamsley et al. | 211/4 |
| 2011/0215061 | A1 * | 9/2011 | Niederhuefner et al. | 211/59.3 |

* cited by examiner

*Primary Examiner* — Korie H Chan

(74) *Attorney, Agent, or Firm* — Razmig Messerian; Loza & Loza, LLP

(57) ABSTRACT

A dispenser for containers is disclosed, consisting of a rail, a front retainer and a pusher coil secured within a pusher. The rail serves to suspend the containers held by their lip, while the pusher, secured within the rail, continuously pushes forward onto the containers. Meanwhile, the front retainer comprises of two abutment protrusions which serve as a barrier to prevent the containers from going too far forward. An individual wishing to remove a container simply has to pull forward on the container such that it makes its way past the barrier created by the abutment protrusions of the front retainer.

6 Claims, 24 Drawing Sheets

DISPENSER FOR CONTAINERS

CLAIM OF PRIORITY

The present application for patent claims priority to U.S. Provisional Patent Application No. 61/505,761 entitled "Dispenser for Containers" filed Jul. 8, 2011, the entire disclosure of which is hereby expressly incorporated by reference herein.

BACKGROUND

1. Field

This disclosure relates to dispensers and, in particular, to dispensers for containers.

2. Background

While standard product dispensers have existed in the market for decades, they have always dispensed the product by its base or its back. Most often, a coil that serves to push the product forward is located behind a pushing member and exerts force on the product to move it in a forward motion.

A plethora of devices have been invented to simplify or accommodate the dispensing of various products, especially on a display rack. Such devices include U.S. Pat. No. 3,308,961 (Chesley), U.S. Pat. No. 5,069,349 (Wear et al.), U.S. Pat. No. 5,450,969 (Johnson et al.) and U.S. Pat. No. 7,032,761 (Nagel), as well as U.S. Patent Application No. 2010/0108624 (Sparkowski).

For example, U.S. Pat. No. 3,308,961 includes a coil, having one extremity attached to the front of the display rack, and the remainder of the roll located behind an abutment plate. This basic system allows for the coil to exert continuous pressure onto the abutment plate such that it travels forward, thus pushing the product in the same forward fashion.

A further example, U.S. Pat. No. 5,069,349, provides a multi-level display with a pusher system on both levels. In this device, the coil is within a housing that consists of two opposing walls pushing a backing plate member onto a product. The base of the multi-level rack consists of ribs and flanges in the shape of wings that latch onto the base of the coil's housing. The ribs and flanges extend horizontally such that the coil's housing slides forwards and backwards pushing the product toward the individual.

A further example, U.S. Pat. No. 5,450,969, is similar to U.S. Pat. No. 3,308,961; however, the coil is secured within two vertical supports that constitute the coil's housing. The housing has wings at its base that are held in place and slide forward and backward along a horizontal path. The coil, along with its housing, allows for a backing plate to push a product forward for retrieval by an individual.

A further example, U.S. Pat. No. 7,032,761, includes a product display rack with a front barrier panel utilized to push products forward. In this instance, the barrier is in the form of a wide upside down V-shape such that the coil can rest within it. There is a small aperture at the base of the barrier base from which the coil can extend and be secured to the front of the rack. The small front barrier panel stops the products from being displaced too far forward.

A final example, U.S. Patent Application No. 2010/0108624, is similar to that of U.S. Pat. No. 7,032,761 in that it also comprises an upside down V-shaped barrier, whereby the coil is secured within it. Again, the coil is tied to the front of the barrier to exert force in a forward motion, moving the barrier along a predefined path along with any product that it is pushing. The difference is within the base of U.S. Patent Application No. 2010/0108624: it can be adjusted laterally such that whether the product that the barrier is pushing is small or large, it can rest on a base of appropriate width to accommodate its size.

Unfortunately, these products all have similar drawbacks: they all push products forward from the base of the products. They are not suitable for potentially smaller dispensers who wish to push products from the neck or lip of the container, bottle, etc. due to containers' conical shape. Further, given the shape of the pushers, they would not be able to adequately push conical or cylindrical products such as containers or bottles due to a lack of contact between the pusher and the container or bottle. The conical or cylindrical products may also lack the necessary contact at their base, such that pushing these products would be difficult and cumbersome. Other drawbacks include: having a front barrier to prevent the product from going too far forward hinders the display of the product, having wide rails on the side of the product can cause taller or slimmer products to tip to one side, and having a coil system at the bottom of the device creates a larger chance of dirt or spillage damaging the coil system.

As such, there is a need for a device that can overcome the drawbacks elaborated herein, while being able to dispense products in a different fashion; namely, by their lip, rim or neck, or dispensed from the top of the product in general. These features of the invention will be apparent from review of the disclosure, drawings and description of the invention below.

SUMMARY

The present invention provides a product dispenser that can push containers and the like for easy handling and dispensing.

In a first aspect, the present invention provides a dispenser for at least one container, each of the at least one containers having a lip comprising a rail for slidably engaging each lip of the container; a front retainer operatively coupled to the rail for retaining the container; a pusher operatively coupled to the rail; a back cap operatively coupled to the rail wherein the pusher slides along the rail to push each of the at least one container forward toward the front retainer.

BRIEF DESCRIPTION OF THE DRAWINGS

The embodiments of the present invention will now be described by reference to the following Figures, in which identical reference numerals in different Figures indicate identical elements. Moreover, the Figures may not be to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention.

DETAILED DESCRIPTION

The present invention will now be described more fully hereinafter with reference to the accompanying drawings, in which preferred embodiments of the present invention are shown. This invention may however, be embodied in many different forms and should not be construed as limited to the embodiments set forth herein. Rather, these embodiments are provided so that this application will be thorough in illustrations and brief explanation therefore to convey the true scope of the invention to those skilled in the art. Some illustrations provided herein include detailed explanations of dimension and operation and as such should be not be limited thereto.

The terms "coupled" and "connected," along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

The terms container or containers can be used interchangeably herein and such terms reference a similar item as described herein. The terms container and containers also refer to such a product having a lip or rim wherein the container or containers has a certain rigidity allowing for the container or containers to be held within the dispenser of the present invention. The terms lip or rim can also be used interchangeably herein.

Figure 1:
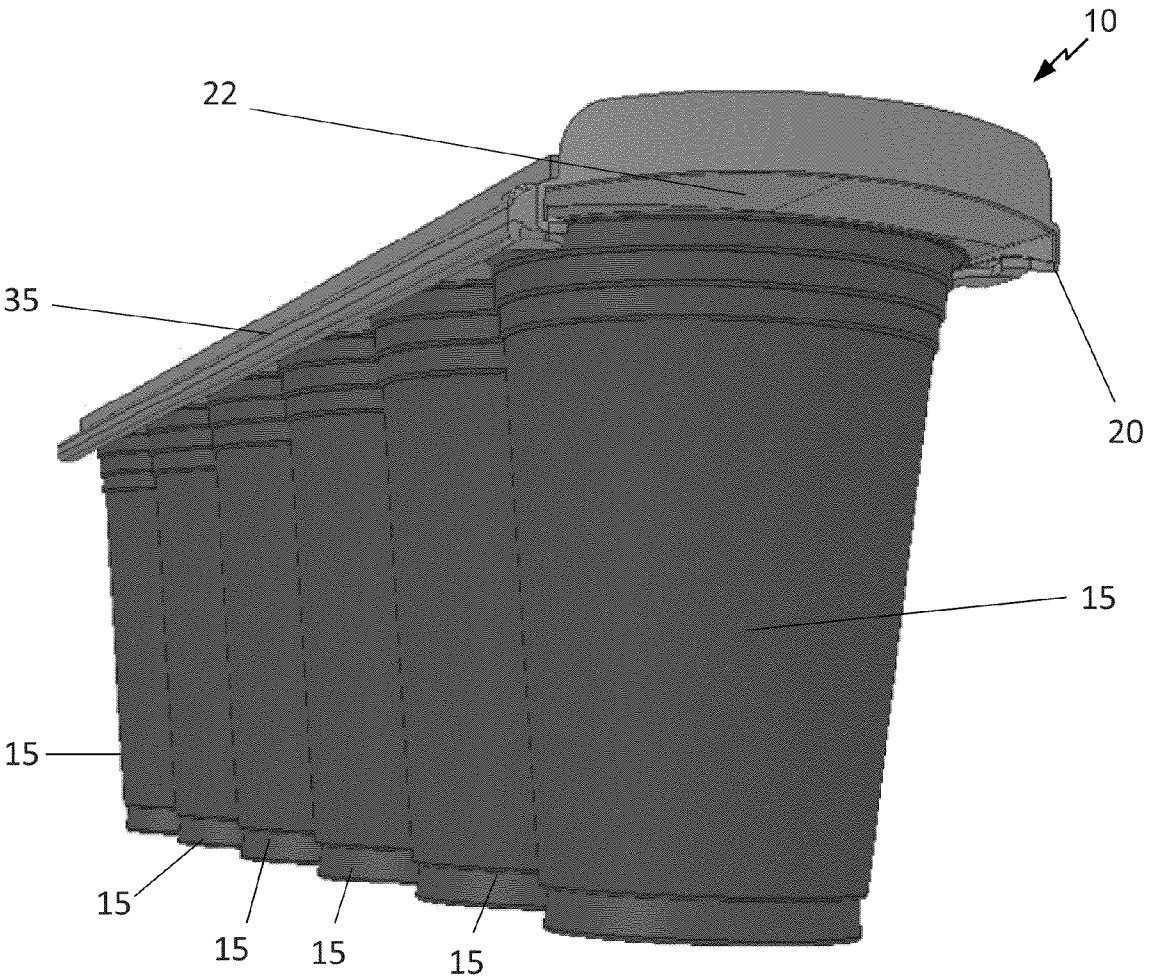
FIG. 1 is a perspective view of a dispenser for containers of the present invention.

With reference to FIG. 1, a dispenser for containers 10 can be seen holding several containers 15. The purpose of the dispenser 10 is to be able to quickly and easily dispense various types of containers, whether containing liquid or other contents, being held by their lip, rim or neck, using a retractable coil to push the container. In one embodiment, a front retainer 20 exists in order to prevent the containers 15 from being displaced out of the rail 35, and has an opening 22 to allow the containers 15 to be removed easily from the dispenser 10. The front retainer 20 is connected to a rail 35 which allows for the containers 15 to be suspended by their lip, and provides for sliding the containers 15 forward to the front retainer 20. Further aspects of the front retainer 20 and rail 35 will be further described below.

Figure 2A:
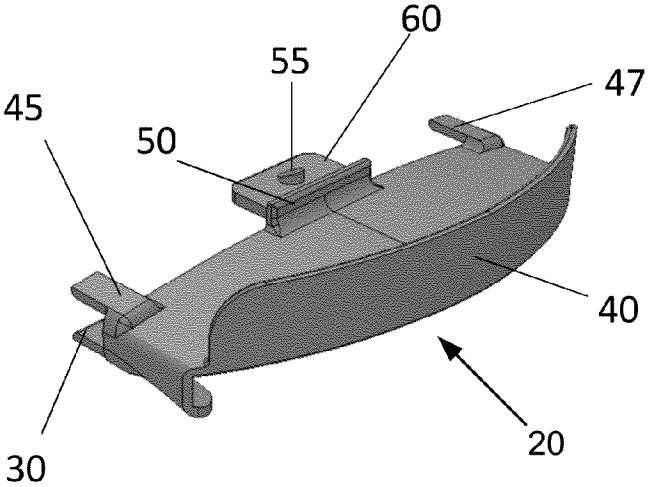
FIGS. 2*a* and 2*b* are perspective views of a front retainer as defined in a dispenser for containers of the present invention.
Figure 2B:
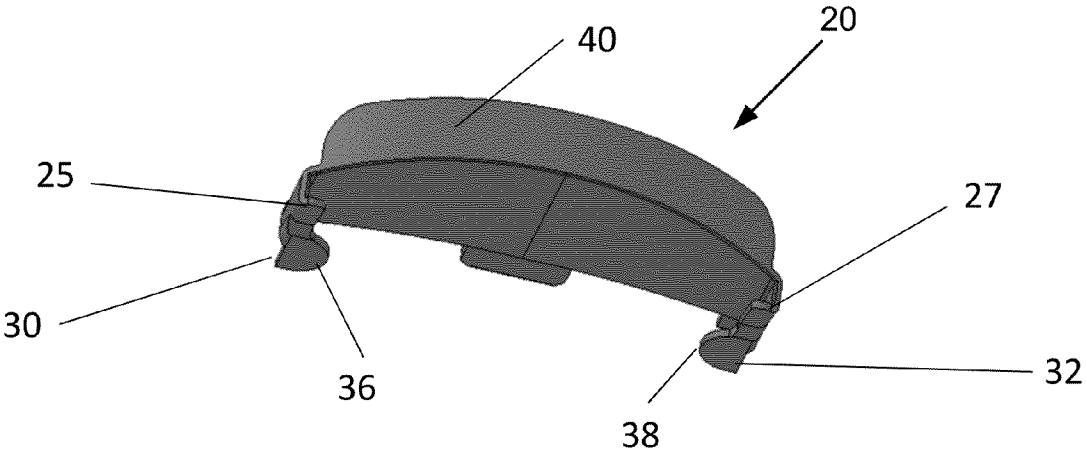
Figure 2C:
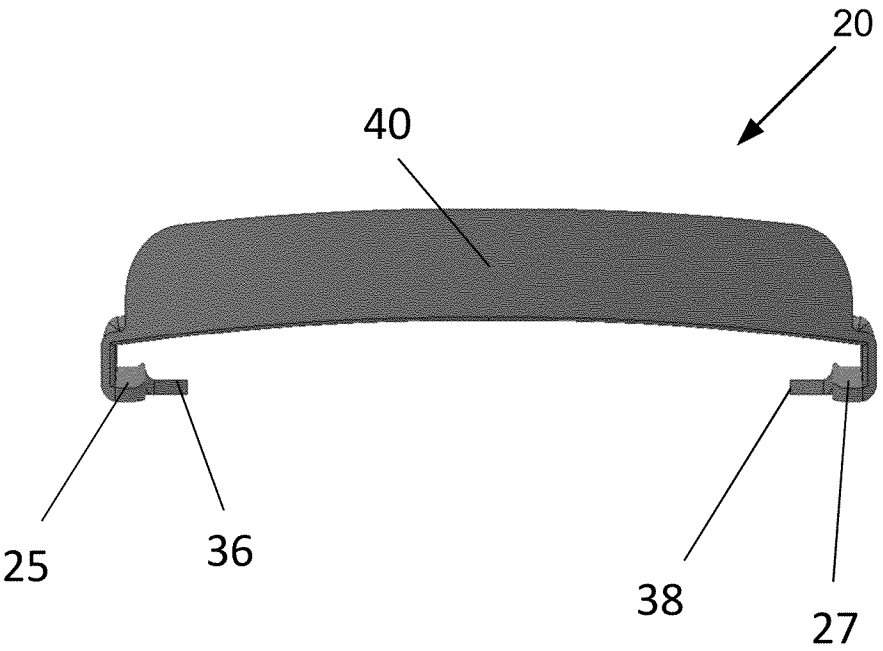
FIG. 2*c* is a front pane view of the front retainer as defined in a dispenser for containers of the present invention.

With reference to FIGS. 2*a*, 2*b* and 2*c*, the front retainer 20, as found in a dispenser for containers of the present invention, can be seen in greater detail. The front retainer 20 has first and second hooks 25, 27, as well as first and second positioning members 30, 32, each having corresponding abutment protrusions 36, 38. The front retainer 20 also has front and back lips 40, 50, with back lip 50 having a protrusion 55 and tongue 60, wherein protrusion 55 helps to secure front retainer 20 to a rail (not shown) of the present invention. The tongue 60 slides into a cavity (not shown) of the rail (not shown), while protrusion 55 connects with a front aperture (not shown) in the rail (not shown) which serves to fasten the front retainer 20 securely within the rail (not shown). With further reference to FIGS. 2*a*, 2*b* and 2*c*, the front retainer 20 also has first and second engagement members 45, 47. The engagement members 45, 47, along with the positioning members 30, 32, are utilized in order to position the rail (not shown) into the front retainer 20. The connection between the rail (not shown) and the front retainer 20 is explained in further detail below.

Figure 3A:
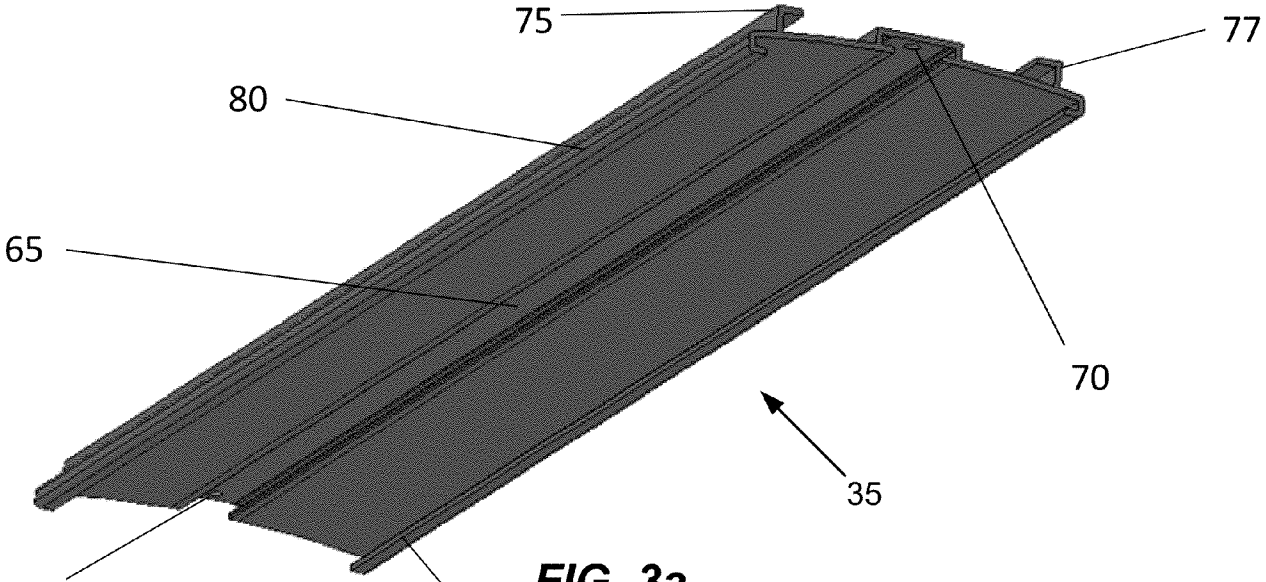
FIG. 3*a* is a perspective view of a rail as defined in a dispenser for containers of the present invention.
Figure 3B:
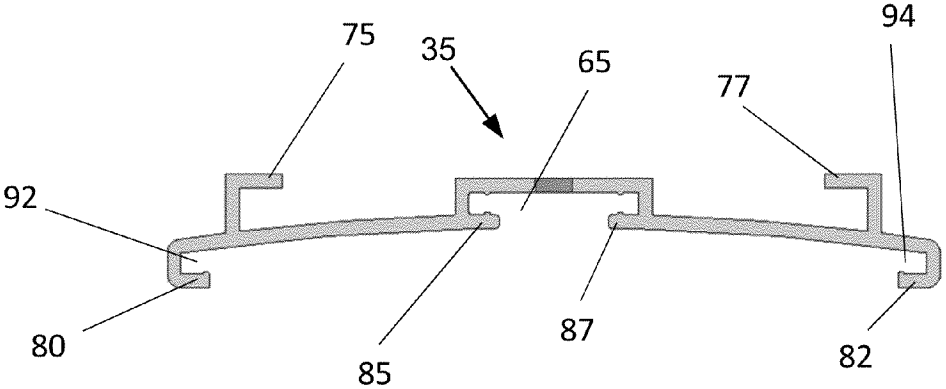
FIG. 3*b* is a cross-section view of the front of the rail as defined in a dispenser for containers of the present invention.
Figures 4A, 4B:
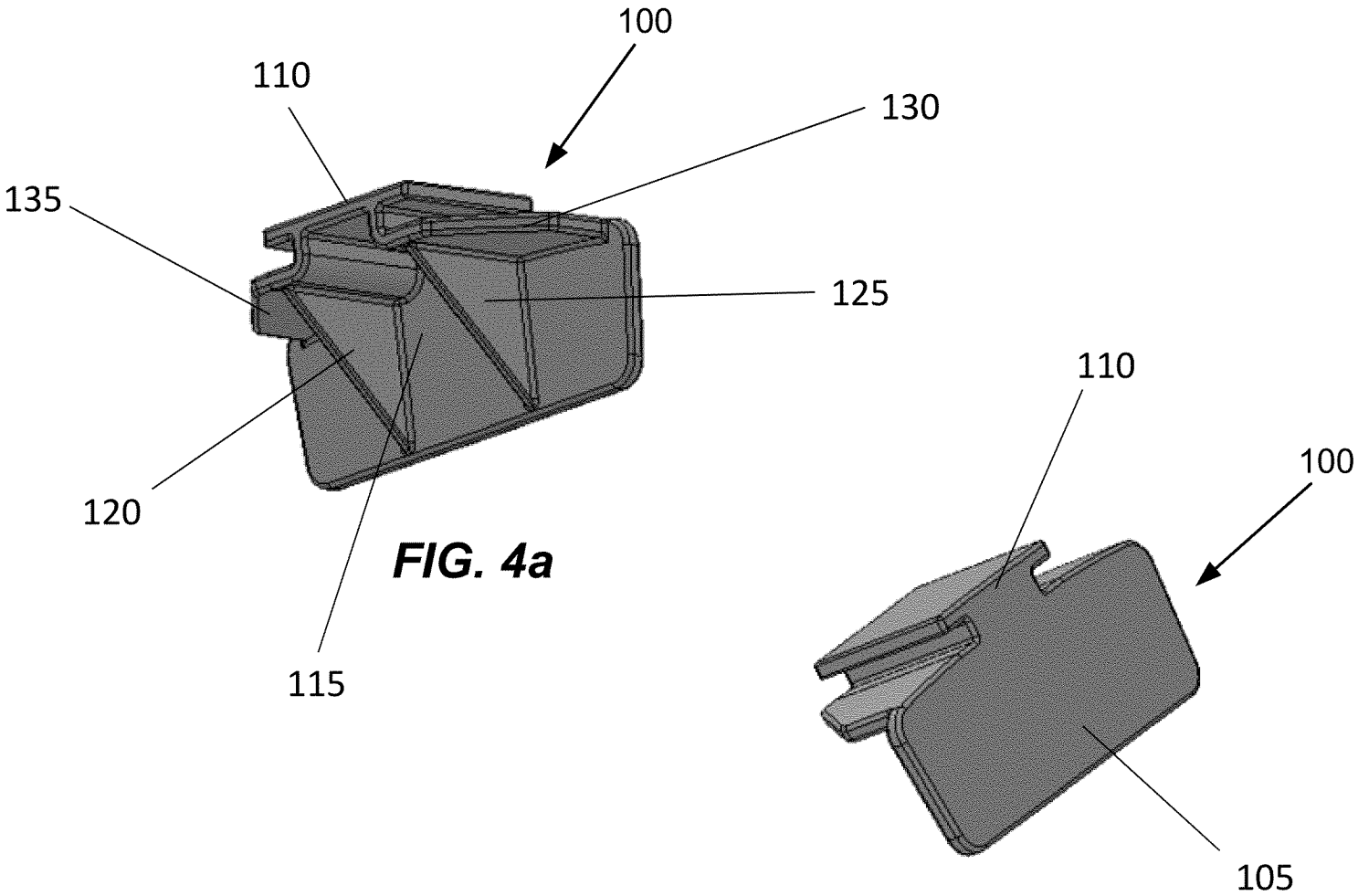
FIGS. 4*a* and 4*b* are perspective views of a pusher member as defined in a dispenser for containers of the present invention.

With reference to FIGS. 3*a*, and 3*b*, in one embodiment, a rail 35 as found in a dispenser for containers of the present invention is shown. Rail 35 has first and second notches 75, 77, opposite one another, which serve to hook into a panel as would be found within a refrigeration unit (not shown) in order to support the dispenser (not shown). Rail 35 has a cavity 65, which serves to house both a pusher's T-shaped neck (not shown), and a pusher coil (not shown) which protracts and retracts depending on whether containers (not shown) are being inserted into or removed from the dispenser (not shown). The cavity 65 includes first and second inwardly-facing walls 85, 87 that prevent the pusher coil (not shown) from falling out of the cavity 65. The cavity 65 has front and back apertures 70, 90. Front aperture 70 located at the front end of the rail 35 serves to connect with the protrusion (not shown) as defined in the front retainer (not shown). Back aperture 90 located at the back end of rail 35 serves to connect with the back protrusion (not shown) as defined in the back cap (not shown). First and second support surfaces 80, 82, are also visible, which serve to hook onto the lip of a container (not shown) or any similar beverage holder comprising of such characteristics. Other embodiments having varying gaps 92, 94, as described within the rail 35 and based on the container being positioned in the rail 35 are described below. The rail 35 slidably engages each lip of the containers positioned within it.

With reference to FIGS. 3*a*, 3*b*, 4*a* and 4*b*, a pusher 100 as found in a dispenser for containers of the present invention is shown. The pusher 100 has a front panel 105 which serves to make contact with a container (not shown) in order to exert force onto the back of the container (not shown). The pusher 100 has a hollow housing 115, which serves to house a pusher coil (not shown). The housing 115 further comprises outer walls 120, 125 which contain the pusher coil (not shown) within the housing 115. The pusher 100 also has a T-shaped neck 110. The T-shaped neck 110 corresponds to the shape of the cavity 65 as defined in the rail 35, allowing the T-shaped neck 110 to be inserted into the cavity 65 such that pusher 100 is secured within the rail 35. First and second wings 130, 135 located beneath the T-shaped neck 110, make contact with first and second inwardly-facing walls 85, 87 which further secures the pusher 100 within the rail 35.

Figure 5:
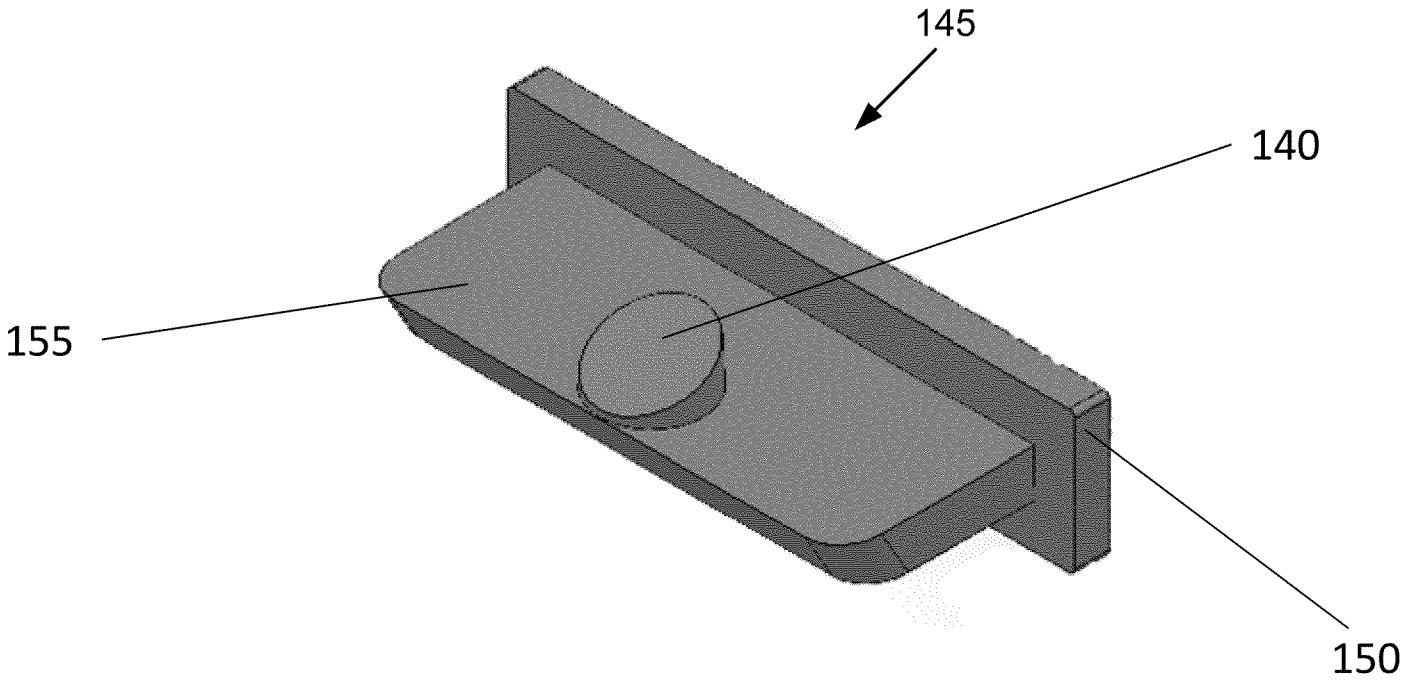
FIG. 5 is a perspective view of a back cap as defined in a dispenser for containers of the present invention.

With reference to FIGS. 3*a*, 3*b* and 5, the back cap 145 as found in a dispenser for containers of the present invention is shown in FIG. 5. The back cap 145 has a back tongue 155 and a back protrusion 140, wherein the back protrusion 140 helps to secure the back cap 145 to a rail 35 of the present invention. The back tongue 155 slides into a cavity 65 of the rail 35, while the back protrusion 140 connects with a back aperture 90 in the rail 35, which serves to prevent the pusher (not shown) from sliding out of the rail 35. The back protrusion 140 has an angled face such that it easily slides into the cavity 65 and can remain engaged with the back aperture 90. The back cap 145 further comprises of back plate 150 which prevents the back cap 145 from completely sliding into the cavity 65.

Figure 6:
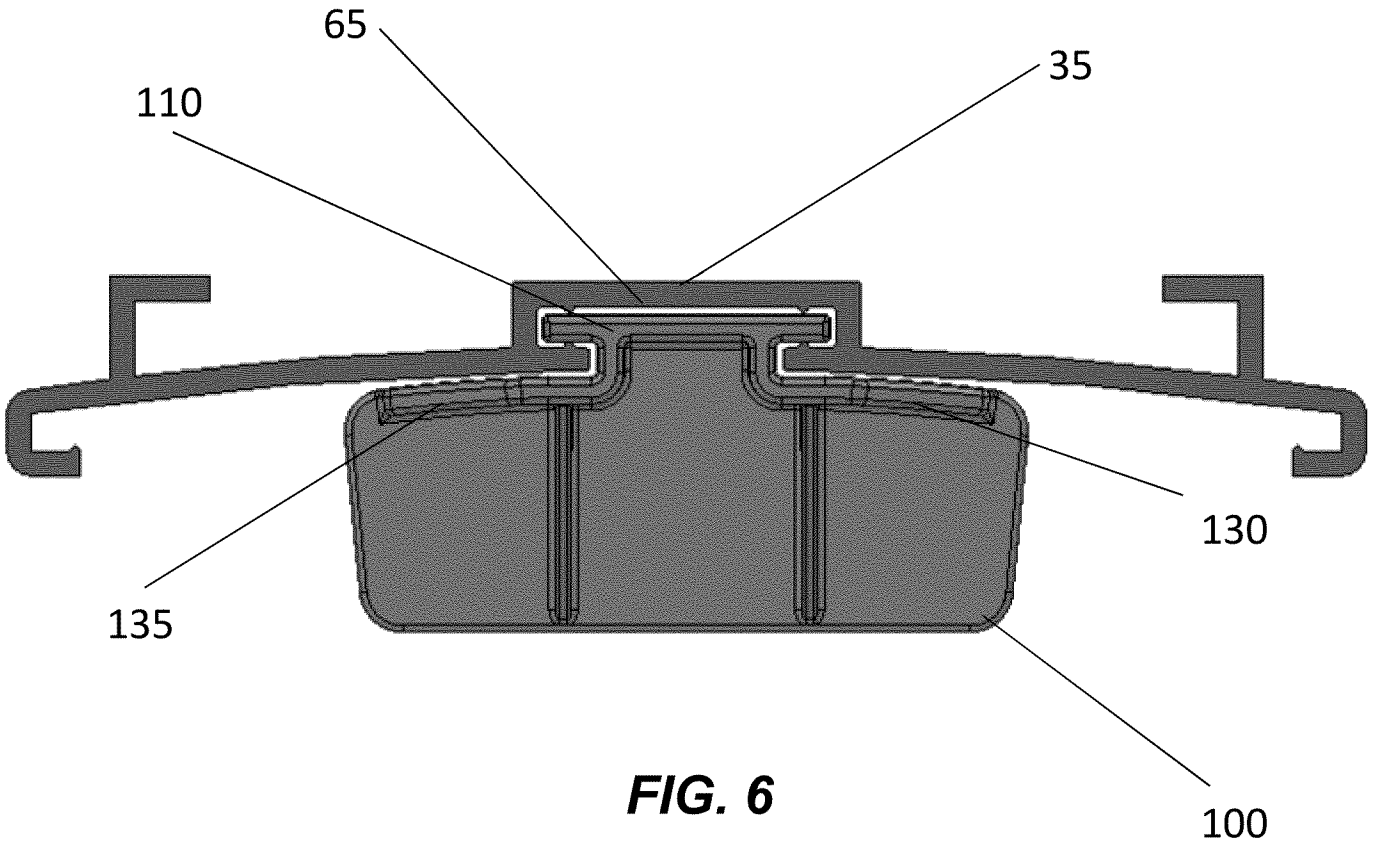
FIG. 6 is a cross-section view of the pusher within the rail as defined in a dispenser for containers of the present invention.

With reference to FIG. 6, the pusher 100 can be seen operatively connected within rail 35. The T-shaped neck 110 is located within the cavity 65 of the rail 35. First and second wings, 130, 135 can be seen, providing additional structural support in order for pusher 100 to be secured within the cavity 65. The pusher 100 can slide along the horizontal axis of the cavity 65 such that the containers (not shown) are pushed in a forward motion relative to the back of the dispenser (not shown).

Figure 7:
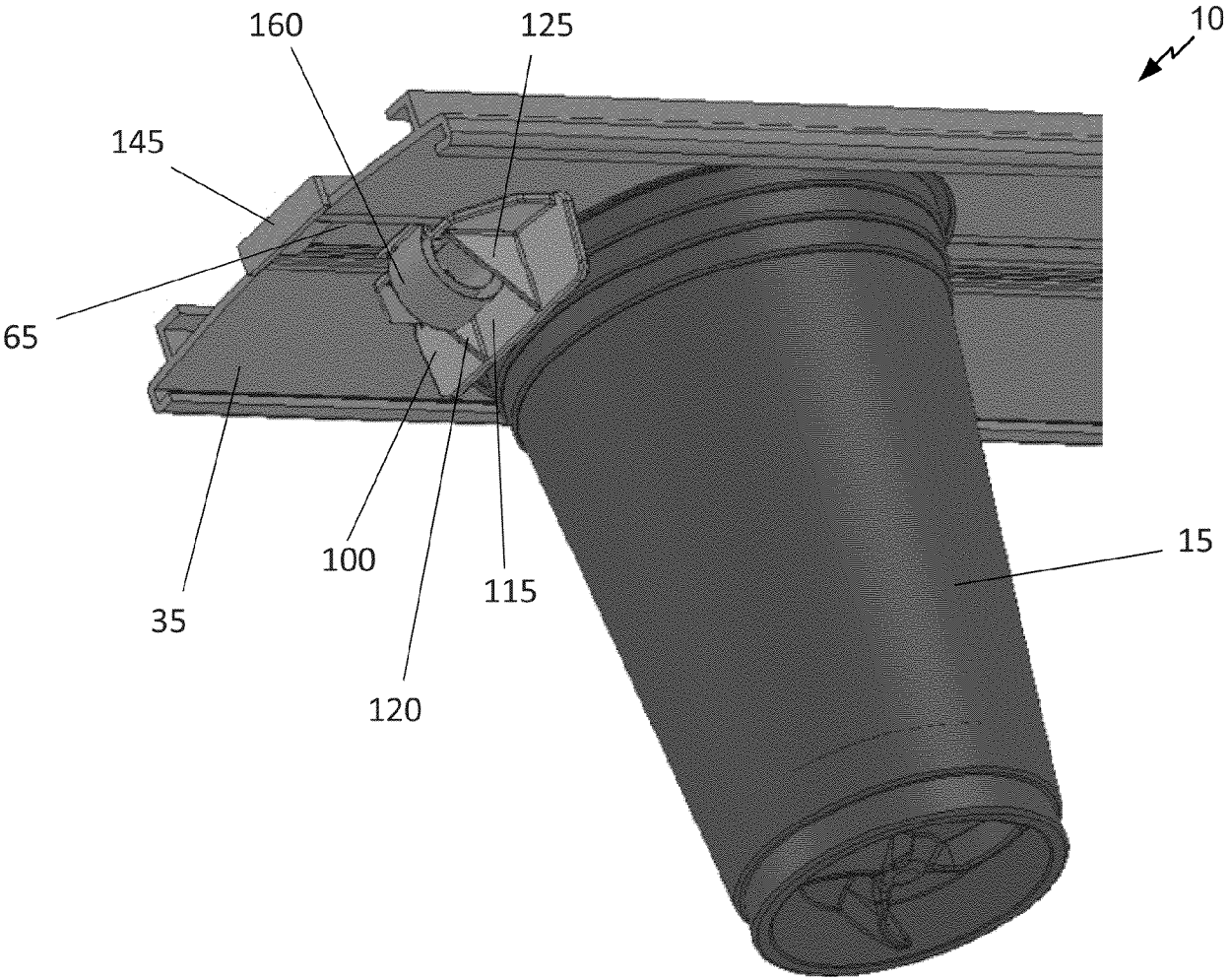
FIG. 7 is a perspective view of the pusher, back cap, pusher coil, rail and container as defined in a dispenser for containers of the present invention.

With reference to FIG. 7, a dispenser for containers 10 can be seen, having a pusher 100 pushing a container 15 along a rail 35. A pusher coil 160 can be seen within the hollow housing 115 of the pusher 100. Pusher coil 160 is contained within the hollow housing 115 by means of outer walls 130, 135. The pusher coil 160 serves to exert force onto the pusher 100 such that it pushes the container 15 forward. A worker skilled in the relevant art would be familiar with the installation of a coil as required to exert pressure on the pusher 100. A back cap 145 is shown and serves to prevent the pusher 100 from escaping the cavity 65 of the rail 35. The back cap as well as the pusher are operatively coupled to the rail 35 and as shown in FIG. 7.

Figure 8:
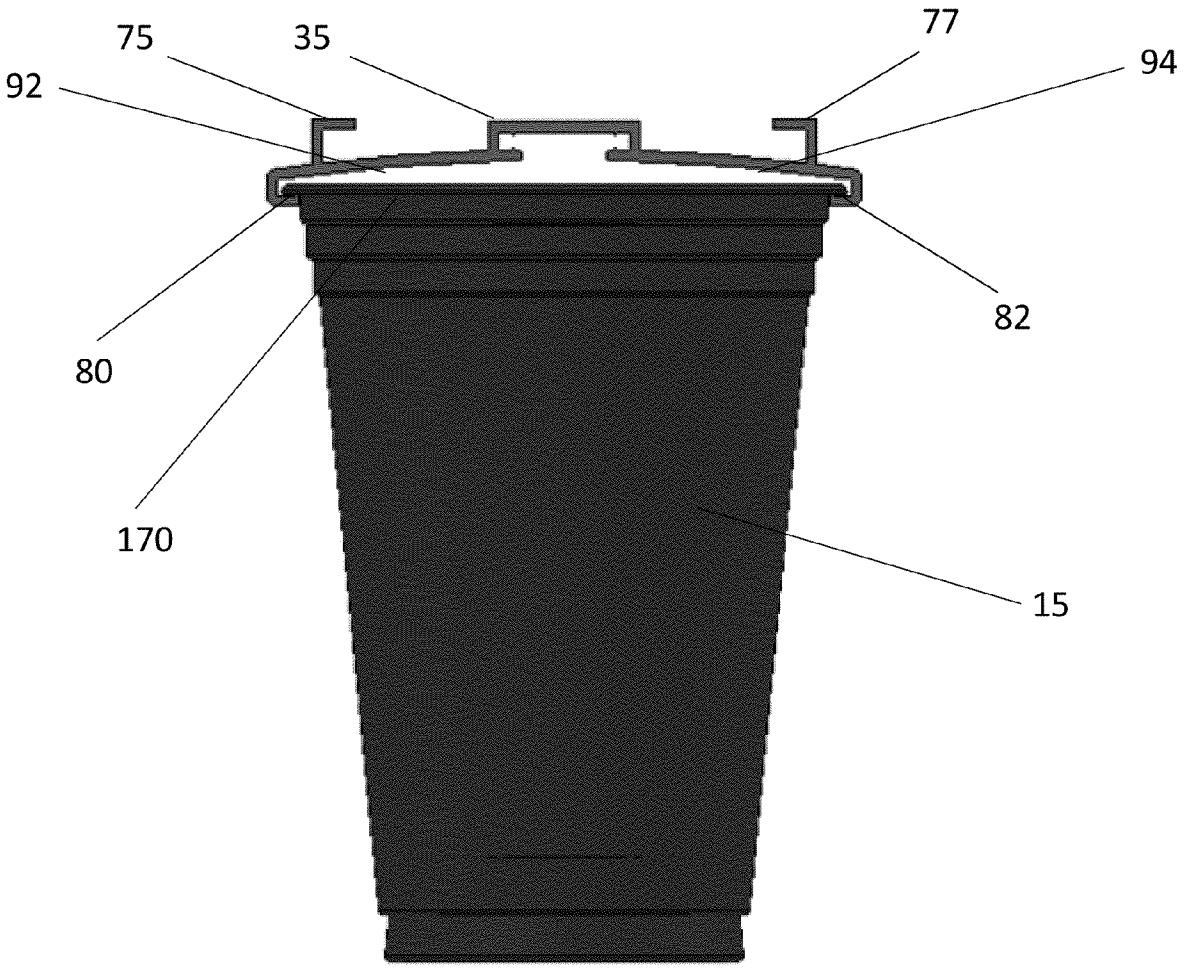
FIG. 8 is a cross-section view of the container within the rail as defined in a dispenser for containers of the present invention.

With reference to FIG. 8, a container 15 can be seen being held by rail 35. First and second support surfaces 80, 82, can be seen supporting the lip 170 of the container. In the present embodiment, gaps 92, 94 are shaped in such a way as to fit the specific lip 170 of the present container 15. A worker skilled in the art would be familiar with varying the gaps 92, 94, based on different sized lips, rims or necks of type of container. Rail 35 has first and second notches 75, 77, opposite one another, which serve to hook into a panel as would be found within a refrigeration unit (not shown) in order to support the dispenser (not shown).

Figure 9B:
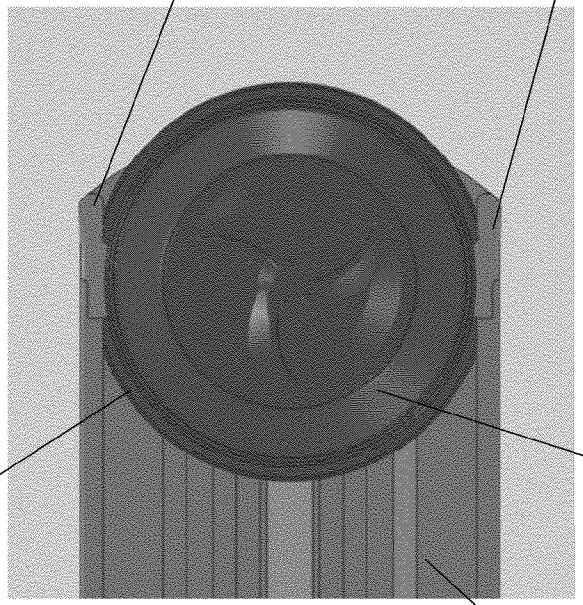
FIGS. 9*a*, 9*b* and 9*c* are bottom pane views of the container within the rail and the front retainer as defined in a dispenser for containers of the present invention.
Figure 9A:
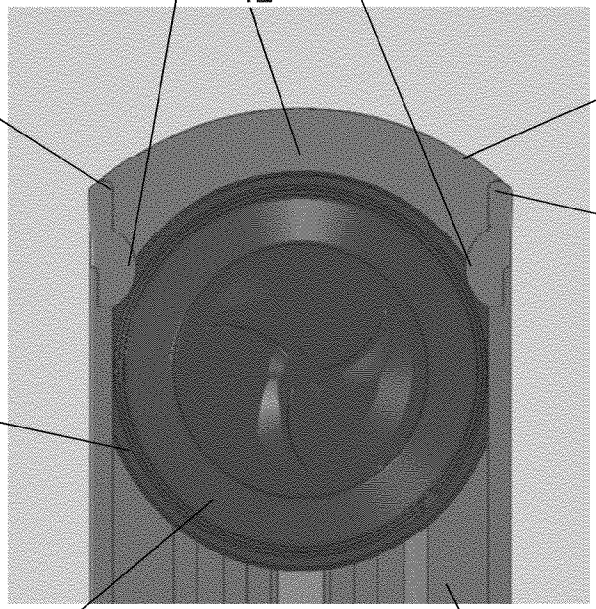
Figure 9C:
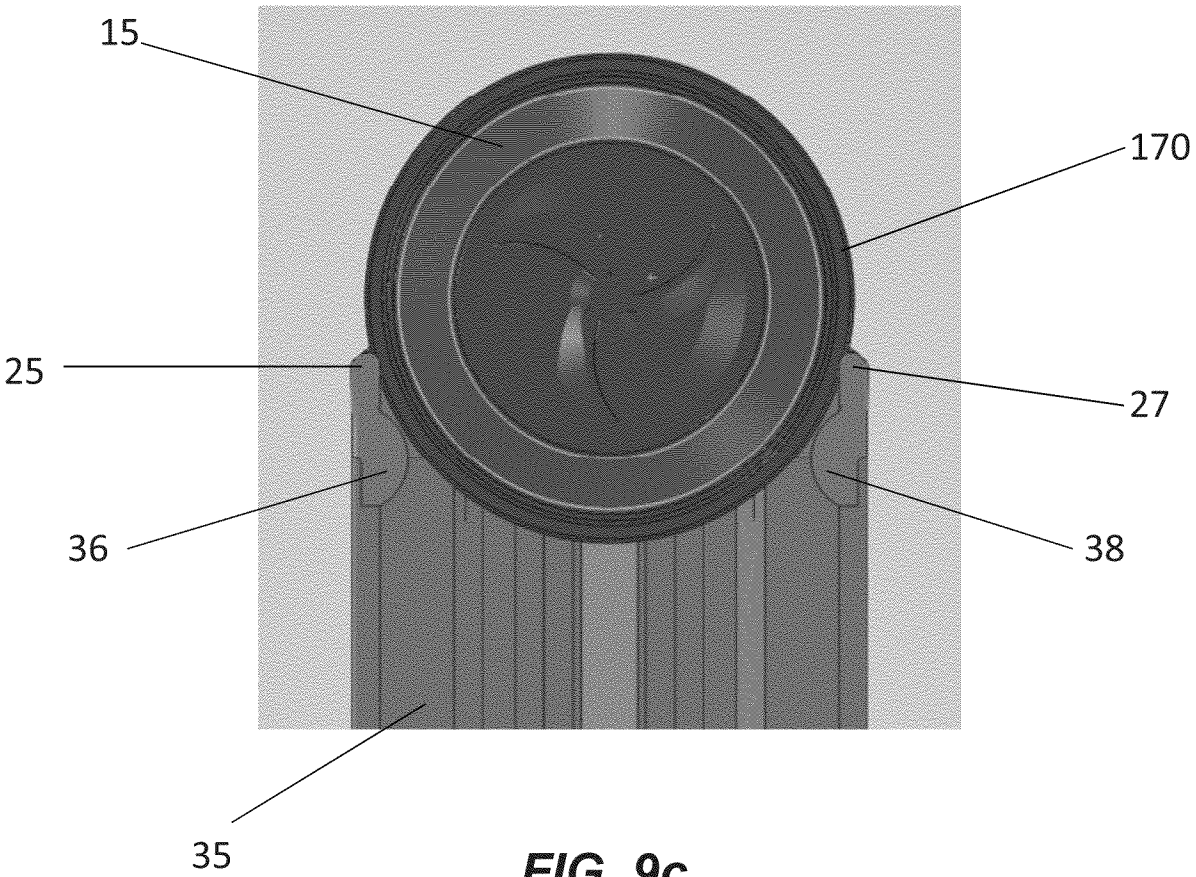

With reference to FIGS. 9*a*, 9*b* and 9*c*, a container 15 can be seen being removed from the rail 35 and the front retainer 20. With specific reference to FIG. 9*a*, the container 15 is at rest. The container 15 is being held by its lip 170 and cannot move forward due to the abutment protrusions 36, 38. With specific reference to FIG. 9*b*, the container is pushed forward such that the abutment protrusions 36, 38 are exerting force onto the container 15. A worker skilled in the relevant art would be familiar with the necessary container characteristics in order to allow container 15 to travel past abutment protrusions 36, 38. In an alternative embodiment, abutment protrusions 36, 38 could be positioned on surface 42 of the front retainer 20. In yet another embodiment, abutment protrusions could consist of an elastomer with a specified rigidity. The lip 170 of the container 15 is now being supported by the corresponding first and second hooks 25, 27 of the front retainer 20 (not shown). With specific reference to FIG. 9*c*, the container 15 has cleared the abutment protrusions 36, 38. The lip 170 of the container 15 is barely resting on the first and second hooks 25, 27 such that the container 15 has almost cleared the front retainer 20 and is within the hands of the individual. The front retainer 20 is operatively coupled to the rail 35.

Figure 10B:
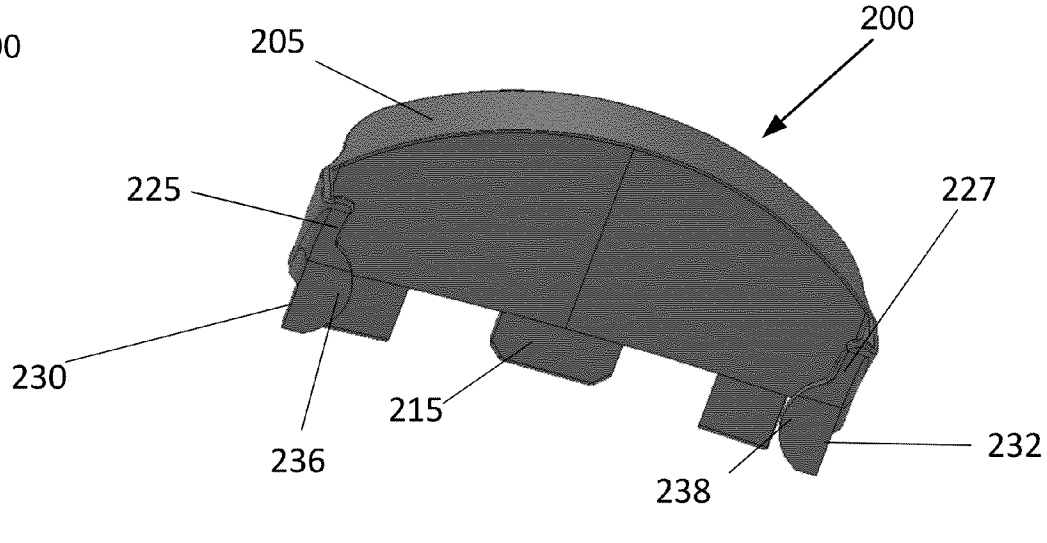
FIGS. 10*a* and 10*b* are perspective views of a front retainer as defined in an alternative embodiment of a dispenser for containers of the present invention.
Figure 10A:
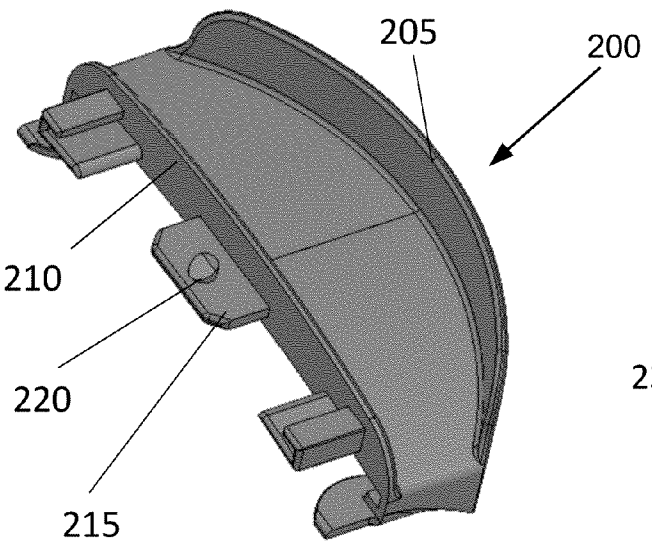
Figure 10C:
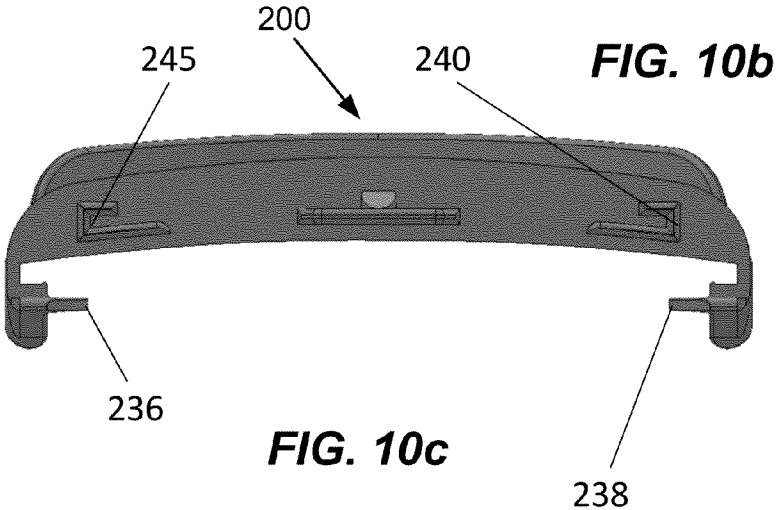
FIG. 10*c* is a front pane view of the front retainer as defined in an alternative embodiment of a dispenser for containers of the present invention.

With reference to FIGS. 10*a*, 10*b* and 10*c*, an alternative embodiment of a front retainer 200 is shown. The front retainer 200 also has front and back lips 205, 210, as well as a tongue 215 and a protrusion 220. The tongue 215 and protrusion 220 are both utilized in order to fit into a cavity (not shown) of a rail (not shown) and secure the front retainer 200 within the rail (not shown). The front retainer 200 also has first and second guiding members 225, 227, as well as first and second positioning members 230, 232, each having corresponding abutment protrusions 236, 238. With further reference to FIGS. 10*a*, 10*b* and 10*c*, the front retainer 200 also has first and second engagement hooks 240, 245. Engagement hooks 240, 245 serve to connect the front retainer 200 to the first and second notches (not shown) of the rail (not shown).

Figure 11B:
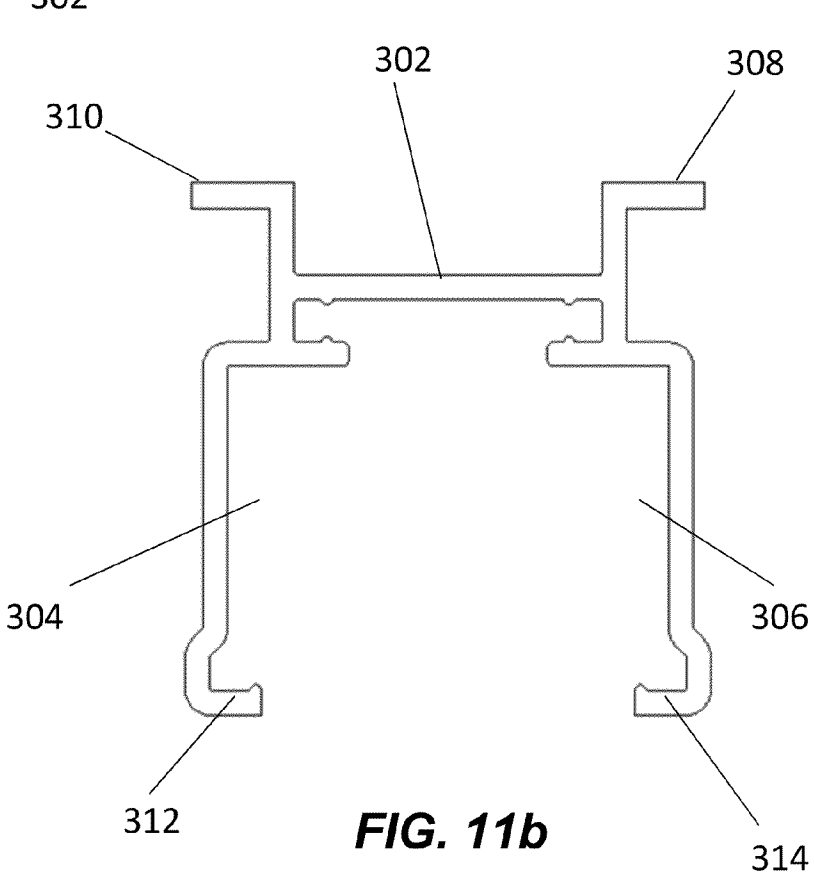
FIG. 11*b* is a cross-section view of a rail as defined in an alternative embodiment of a dispenser for containers of the present invention.
Figure 11A:
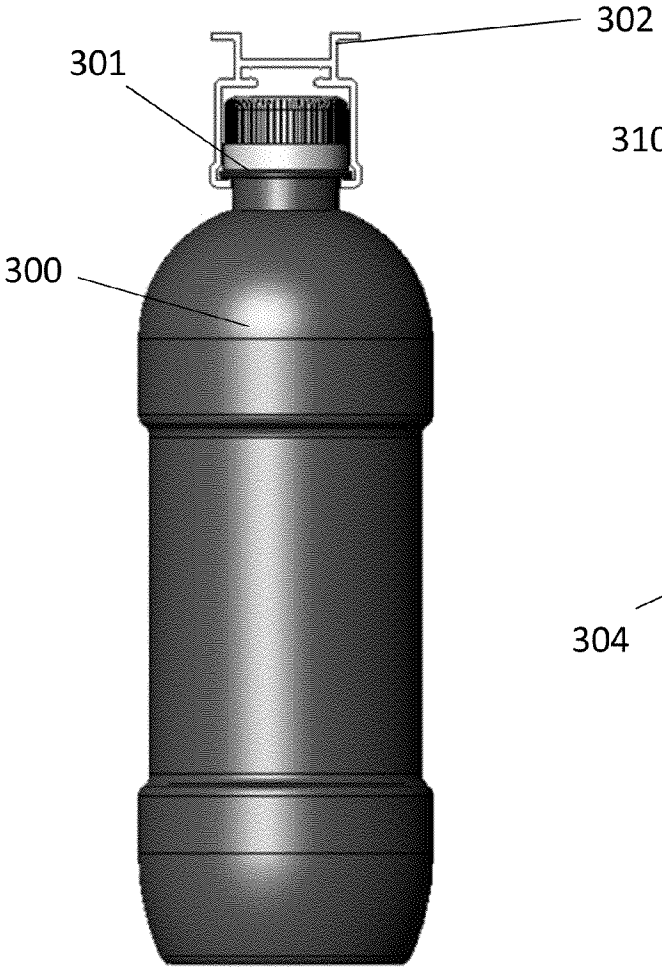
FIG. 11*a* is a front pane view of a bottle within a rail as defined in an alternative embodiment of a dispenser for containers of the present invention.

With reference to FIGS. 11*a* and 11*b*, a different rail embodiment as would be used in the present invention is shown. In this embodiment, a rail 302 can be seen holding a bottle 300 by its rim 301. The gaps 304, 306 of the rail 302 have been widened so as to fit the cap of the bottle 300. Hooks 308, 310 are also present, and serve to hook into a panel (not shown) to support the dispenser (not shown). First and second support surfaces 312, 314 are also shown and support the bottle 300 by its rim 301.

Figure 12B:
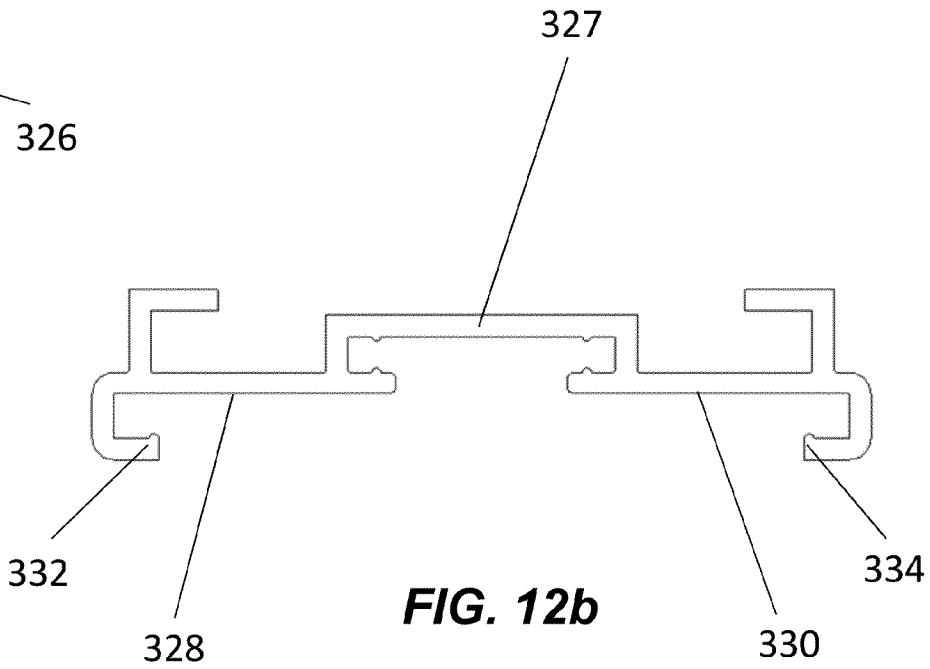
FIG. 12*b* is a cross-section view of a rail as defined in an alternative embodiment of a dispenser for containers of the present invention.
Figure 12A:
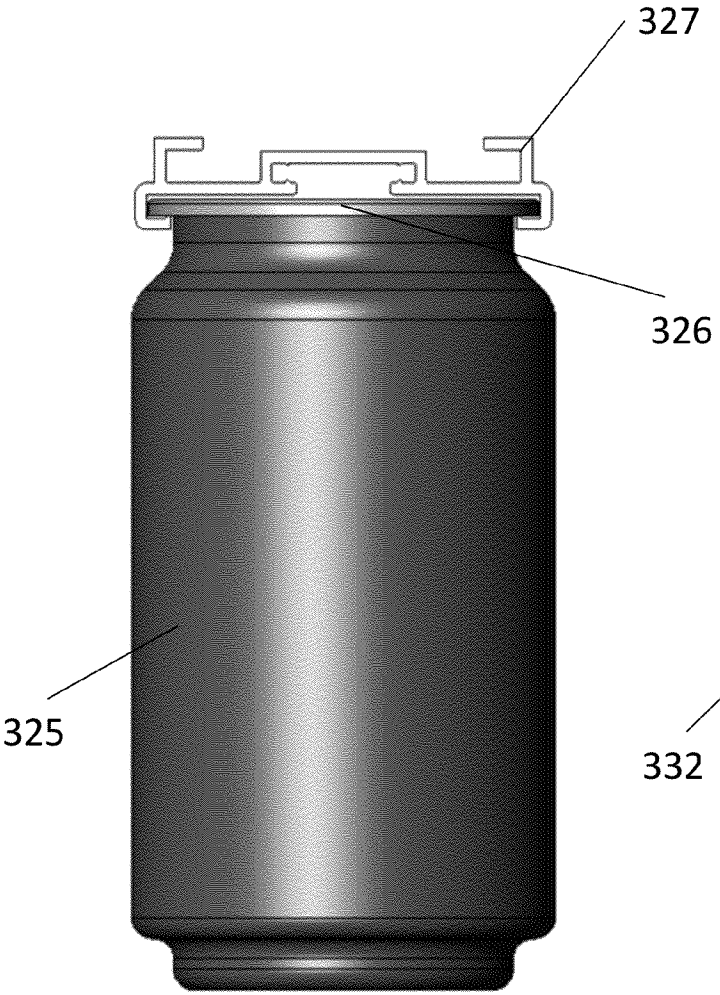
FIG. 12*a* is a front pane view of a can within a rail as defined in an alternative embodiment of a dispenser for containers of the present invention.

With reference to FIGS. 12*a* and 12*b*, another rail embodiment as would be used in the present invention is shown. In this embodiment, a rail 327 can be seen holding a can 325 by its rim 326. The joints, 328, 330 of the rail 327 have been shortened in order to fit the width of the can 325. First and second support surfaces 312, 314 are also shown and support the can 324 by its rim 326.

Figure 13B:
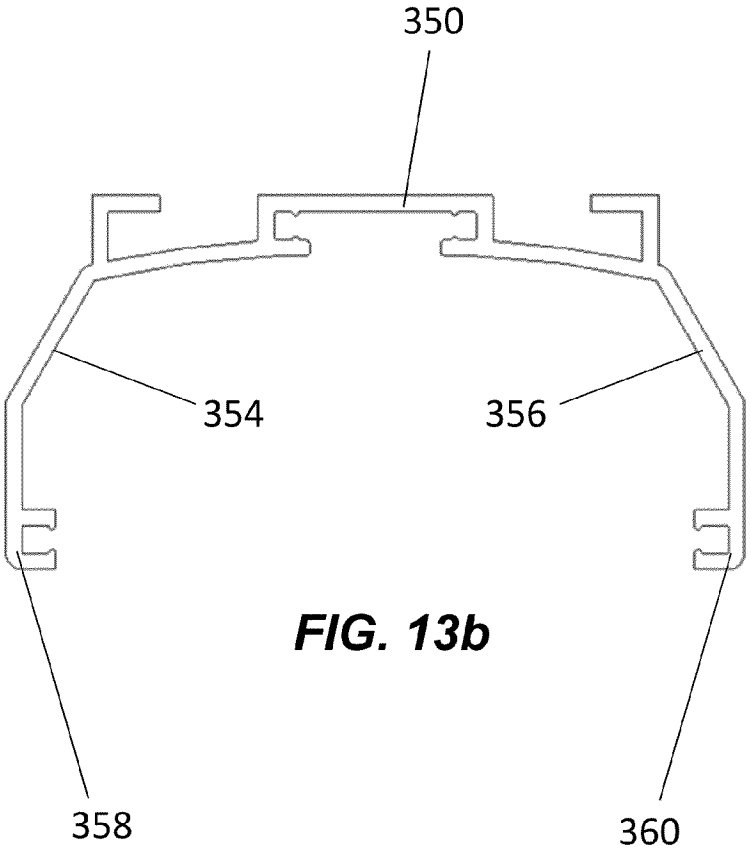
FIG. 13*b* is a cross-section view of a can as defined in an alternative embodiment of a dispenser for containers of the present invention.
Figure 13A:
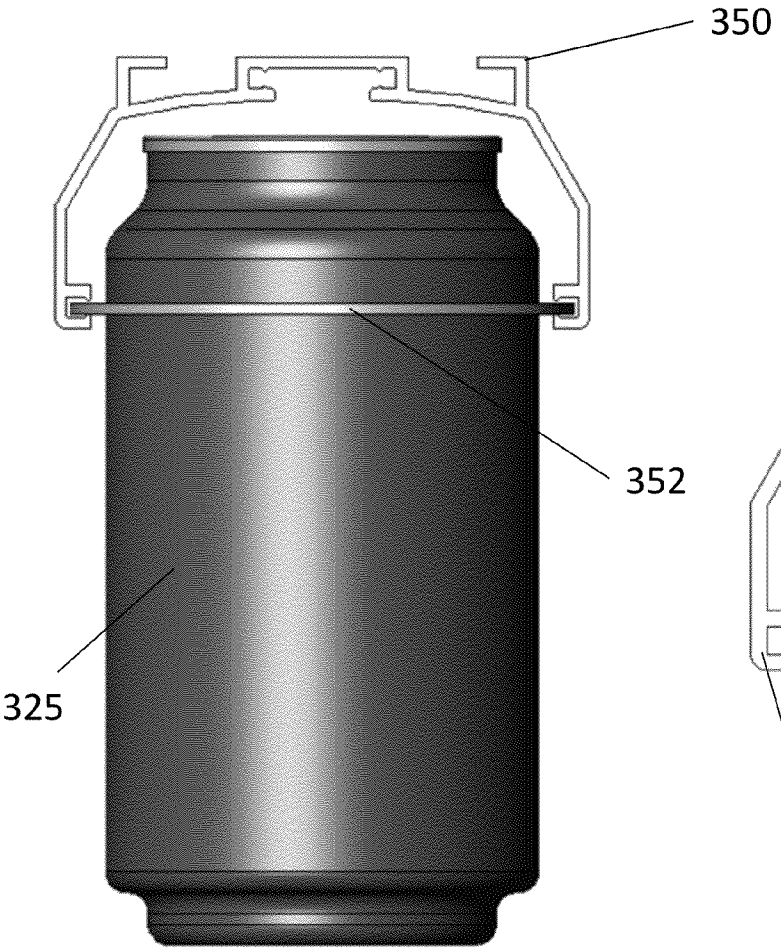
FIG. 13*a* is a front pane view of a can within a rail as defined in an alternative embodiment of a dispenser for containers of the present invention.

With reference to FIGS. 13*a* and 13*b*, another rail embodiment as would be used in the present invention is shown. In this embodiment, a rail 350 can be seen holding a ring 352, which in turn is secured by means of pressure exerted around the width of a can 325. In an alternative embodiment, the ring 352 would form part of the can 325. Handles 354, 356 have been adjusted so to as fit around the contour of the can 325, while first and second support surfaces 358, 360 clasp around the ring 352 of the can 325.

Figure 14A:
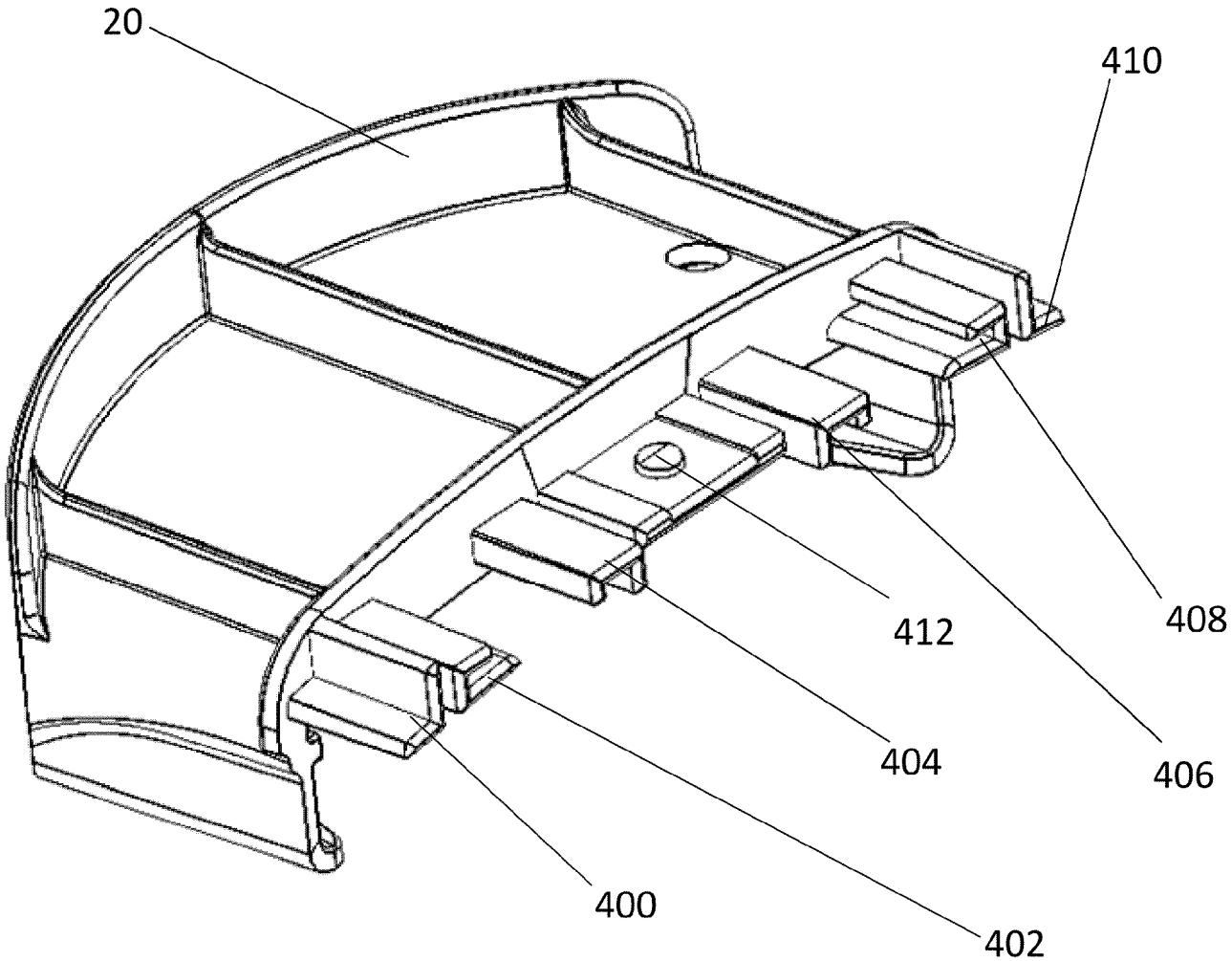
FIG. 14*a* is a perspective view of a front retainer according to another embodiment of a dispenser for containers of the present invention.
Figure 14B:
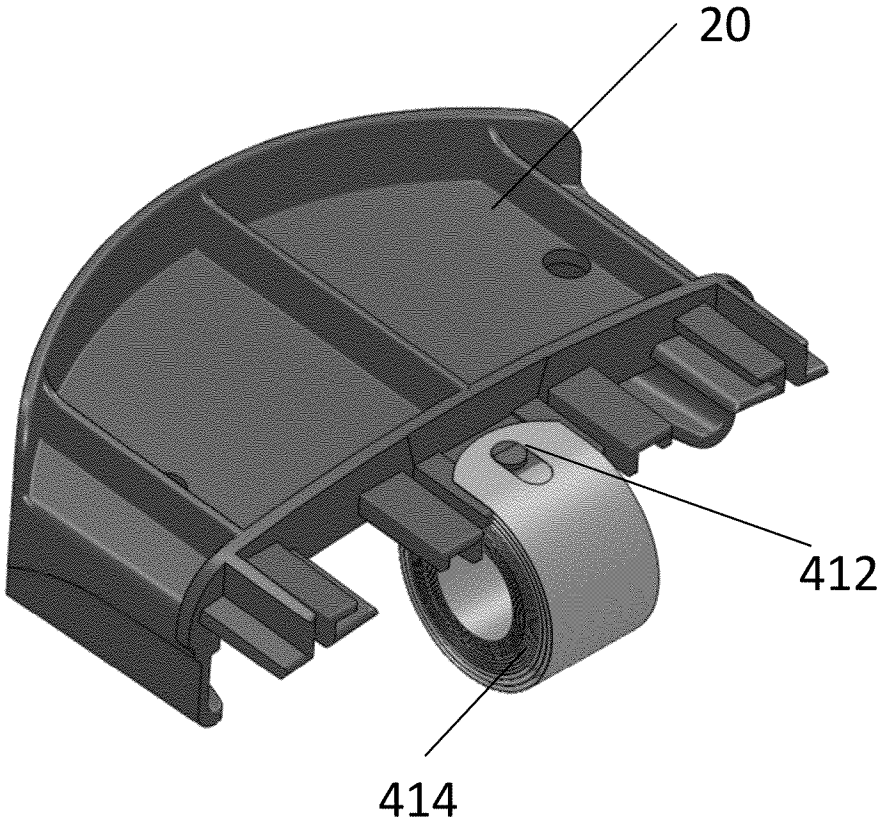
FIG. 14*b* is a perspective view of a front retainer with a coil secured to the front retainer according to one embodiment of a dispenser for containers of the present invention.

With reference to FIG. 14*a*, and in another embodiment of the present invention, the front retainer 20 has positioning members 400, 402, 404, 406, 408 and 410 which have various shapes and are designed to allow for an easy installation onto a corresponding rail (not shown) which can receive such positioning members. The securing of the front retainer 20 under this embodiment is achieved through the use of glue carefully positioned on the various faces of each positioning members 400, 402, 404, 406, 408 and 410. The front retainer 20 also has a mounting pin 412 which is used to secure a coil 414 or a spring for example as shown in FIG. 14*b*. With further reference to FIG. 14*b*, the coil 414 is attached at one end on the retainer through the use of mounting pin 412 and the opposite end of coil 414 is attached at the opposite end of the rail which does not have the front retainer 20 connected to one end.

Figure 15:
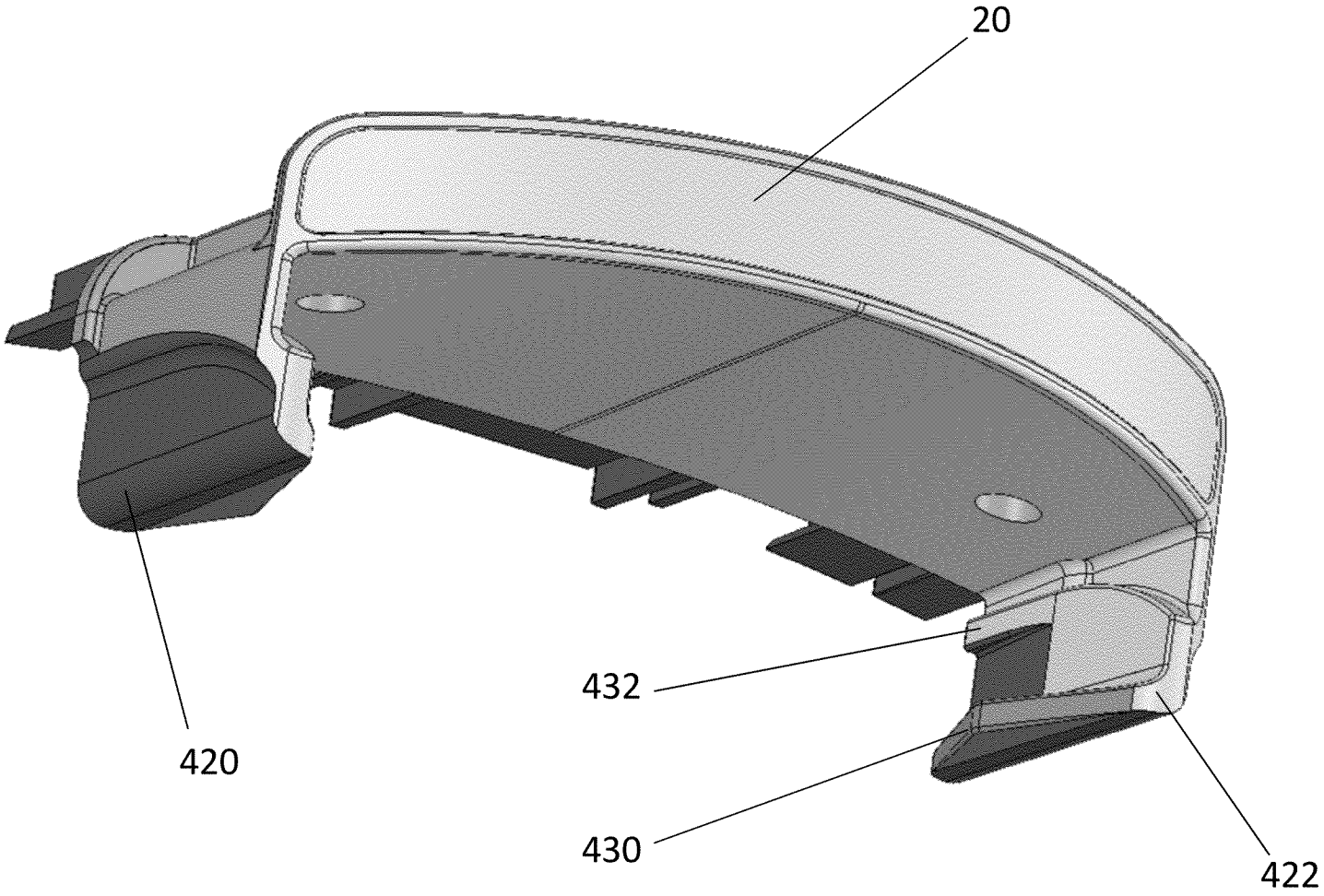
FIG. 15 is a further perspective view of a front retainer according to another embodiment of a dispenser for containers of the present invention.

With reference to FIG. 15 and according to another embodiment of the present invention, the front retainer as defined under FIG. 14*a* is shown. First and second hooks 420 and 422 are shown wherein each of the hooks have two protrusions. The second hook 422 has a first lower protrusion 430 and an upper protrusion 432 which allows for cups (not shown) to remain in the dispenser until an extraction force is applied by a consumer. Corresponding upper and lower protrusions are positioned on the first hook 420. A worker skilled in the relevant art would be familiar with the placement of a number of protrusions within the front retainer allowing to secure a cup or container within the dispenser and such placement would not be outside the scope of the present invention.

Figure 16:
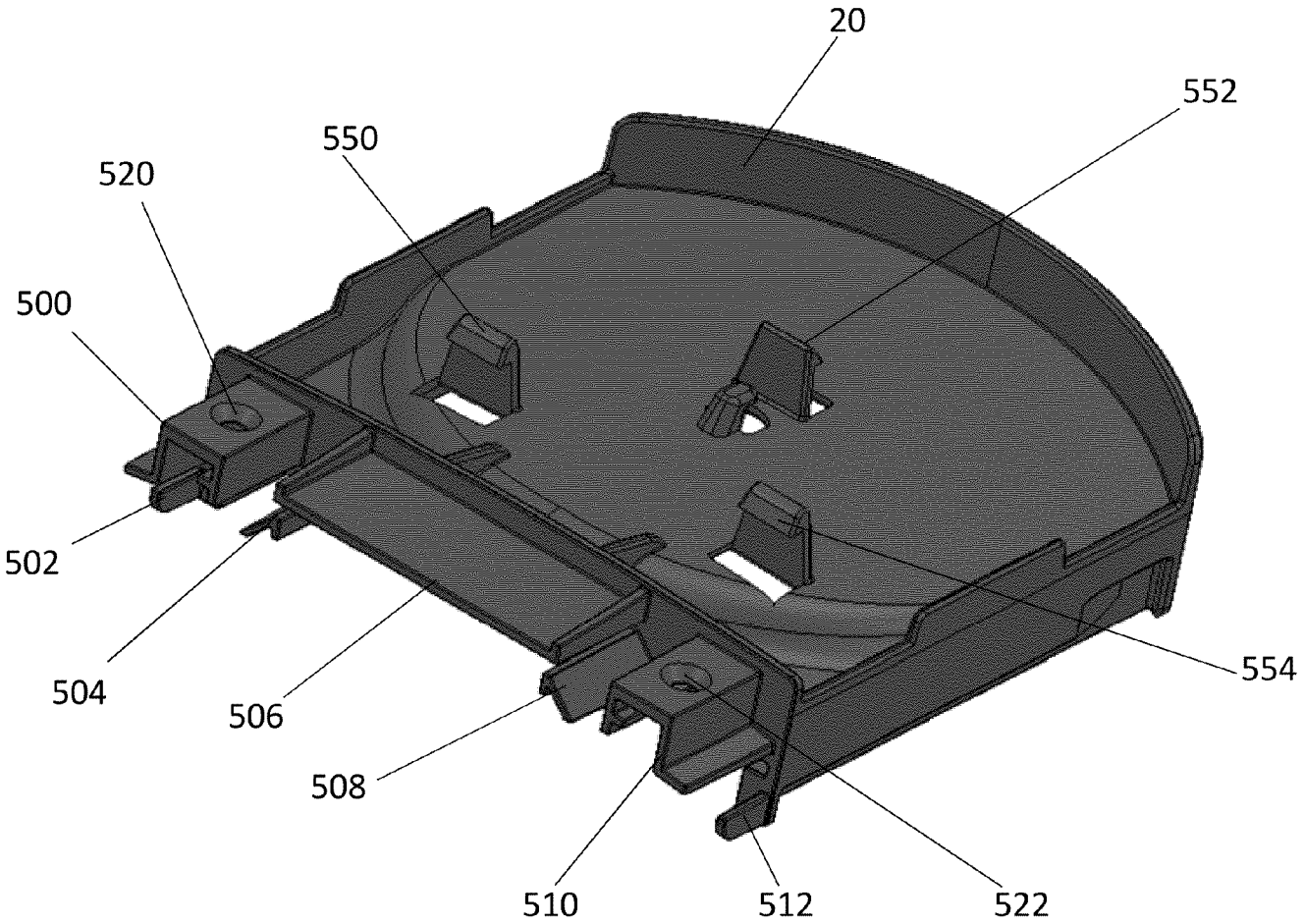
FIG. 16 is a perspective view of a front retainer according to another embodiment of a dispenser for containers of the present invention.

With reference to FIG. 16 and according to another embodiment of the present invention, another front retainer 20 is shown. Specifically, the front retainer has various positioning members 500, 502, 504, 506, 508, 510 and 512 which also allow for an easy installation onto a corresponding rail (not shown). Positioning members 500 and 510 have apertures 520 and 522 allowing for the insertion of screws (not shown) to secure the front retainer 20 to a rail (not shown). With further reference to FIG. 15, the front retainer 20 also has securing protrusions 550, 552 and 554 allowing the front retainer to be installed directly onto a cross bar (not shown) as would be found in refrigeration units. Securing grooves 560, 562, 564 and 566 are also present which allow for interconnectivity with a cross bar (not shown) found in refrigeration units or any other unit that stores containers or cups with rims.

Figure 17:
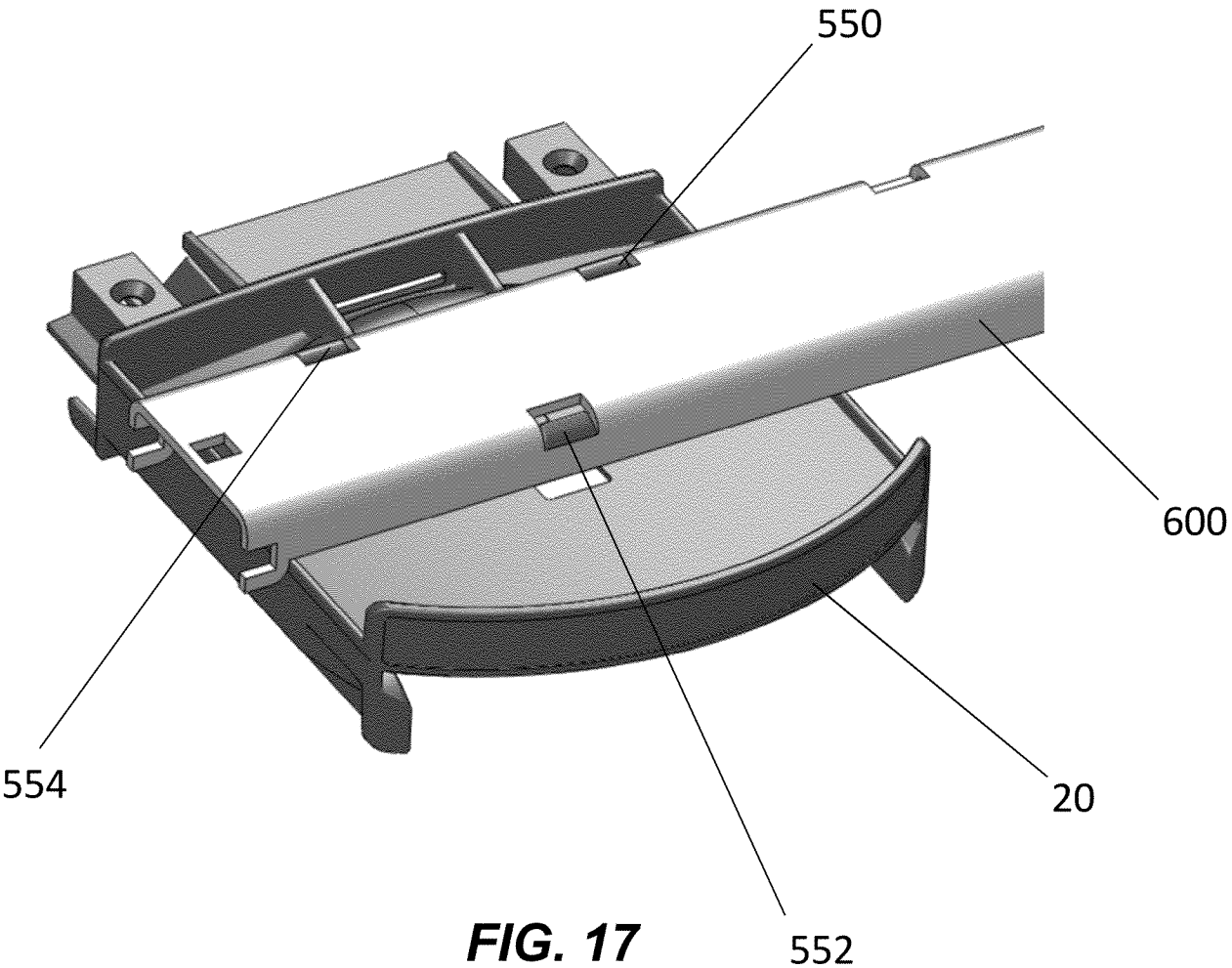
FIG. 17 is a perspective view of a front retainer according to one embodiment of the present invention being secured to a crossbar.

With reference to FIG. 17, the front retainer 20 as described in FIGS. 15 and 16 is shown installed on a crossbar 600. Securing protrusions 550, 552 and 554 connect with the crossbar 600 through apertures present in the crossbar 600. The securing protrusions 550, 552 and 554 have some level of mobility and can snap into the apertures of the crossbar 600. A worker skilled in the relevant art would be familiar with various methods to secure the front retainer 20 to the crossbar 600 without being outside the scope of the present invention.

Figure 18:
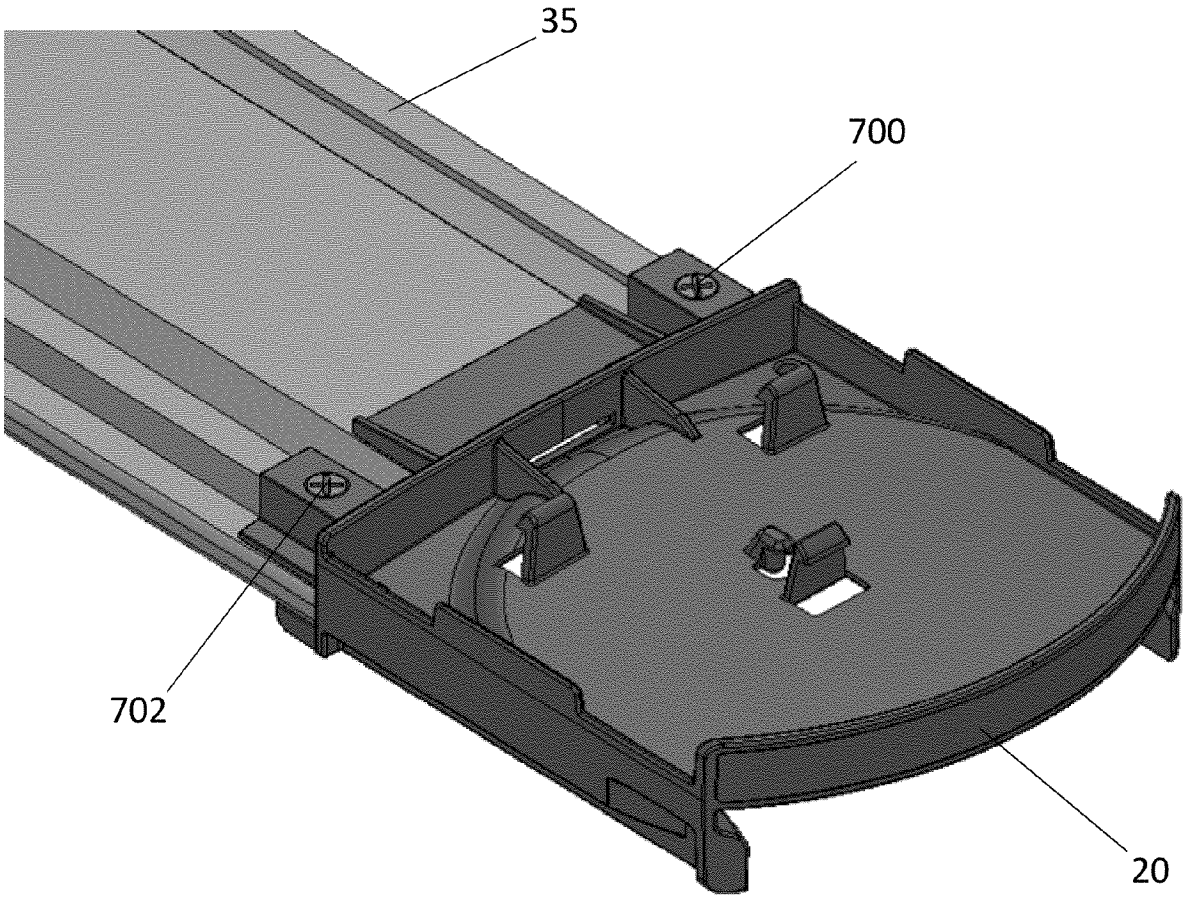
FIG. 18 is a perspective view of a front retainer according to one embodiment of the present invention being secured to a rail.

With reference to FIG. 18, the front retainer 20 as shown in FIGS. 15, 16 and 17 is shown connected to a rail 35 of the present invention. Screws 700 and 702 connect the front retainer 20 to the rail 35 which is secured in a unit (not shown) to store containers. With further reference to FIG. 18, the front retainer 20 has its positioning members all interconnecting with the rail 35 having corresponding grooves to receive the front retainer 20.

Figure 19:
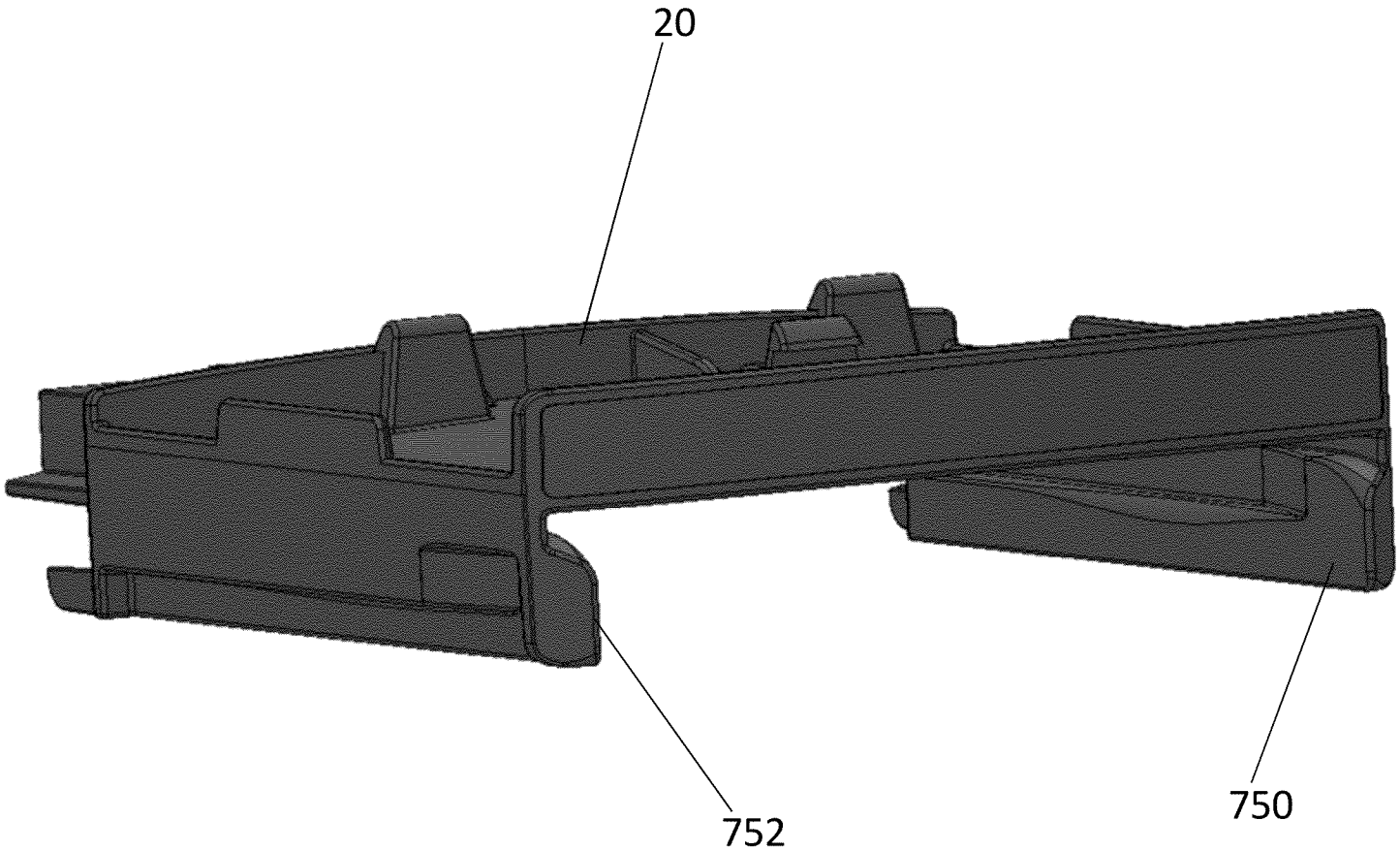
FIG. 19 is a perspective view of another embodiment for a front retainer of the present invention.

With reference to FIG. 19, the front retainer 20 as described under FIG. 15 is shown having protrusions 750 and 752. The front retainer 20 under this embodiment has two corresponding protrusions 750 and 752 which allow to secure containers onto the dispenser until an extraction force is applied by a consumer.

Figure 20B:
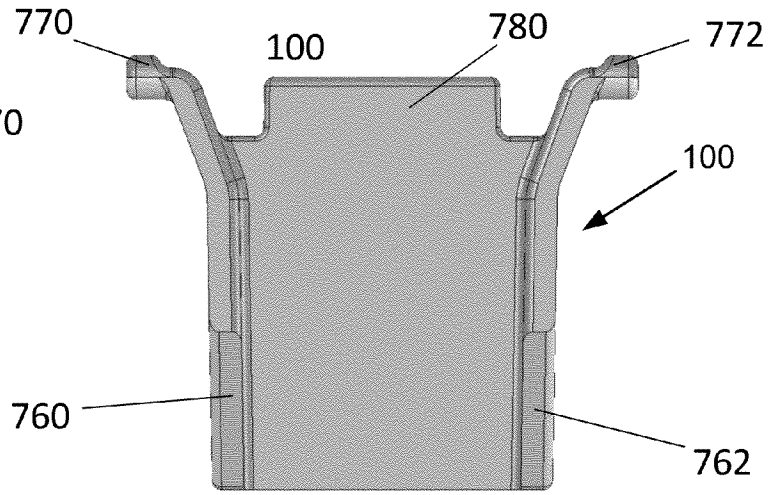
FIG. 20*b* is a front view of a pusher according to one embodiment of the present invention.
Figure 20A:
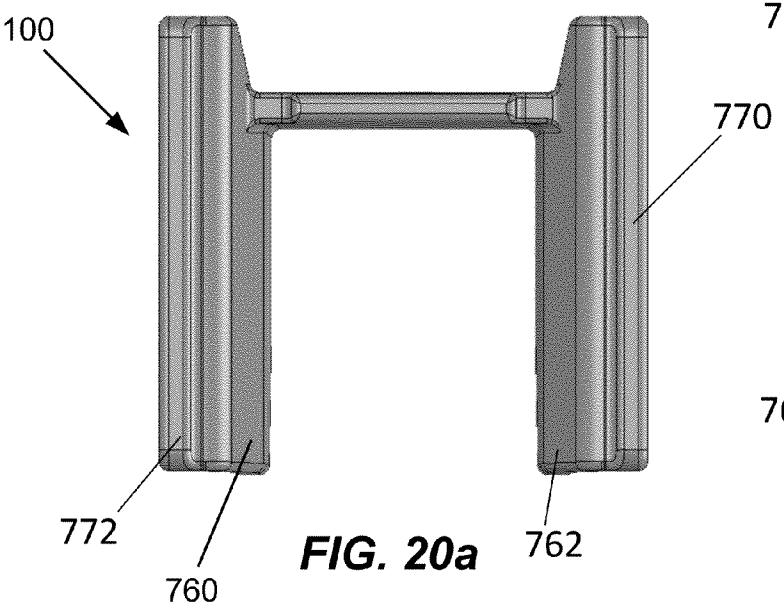
FIG. 20*a* is a top view of a pusher according to one embodiment of the present invention.
Figure 20C:
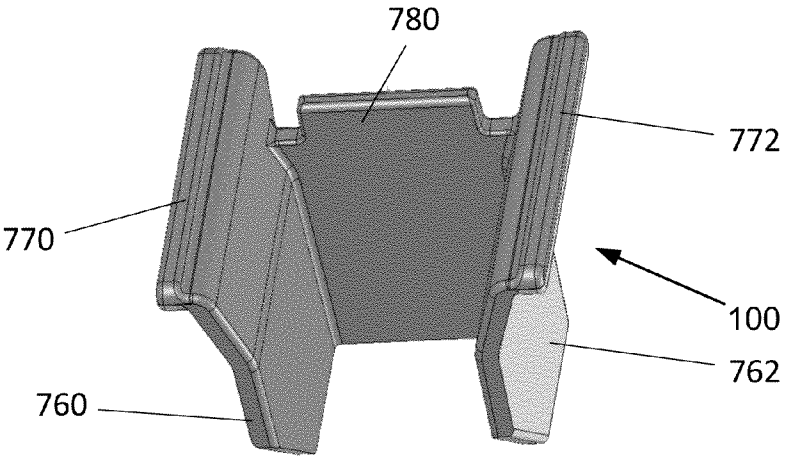
FIG. 20*c* is a perspective view of a pusher according to one embodiment of the present invention.

With reference to FIGS. 20*a*, 20*b* and 20*c*, a pusher 100 is shown according to another embodiment of the present invention. The pusher 100 has a cavity 115 with outward projecting walls 760 and 762 with positioning protrusions 770 and 772 with an interconnecting wall 780. The interconnecting wall 780 and positioning protrusions 770 and 772 are all positioned within a rail (not shown) having a receiving cavity as well as positioning protrusions which allow to receive the interconnecting wall 780 and positioning protrusions 770 and 772.

Figure 21:
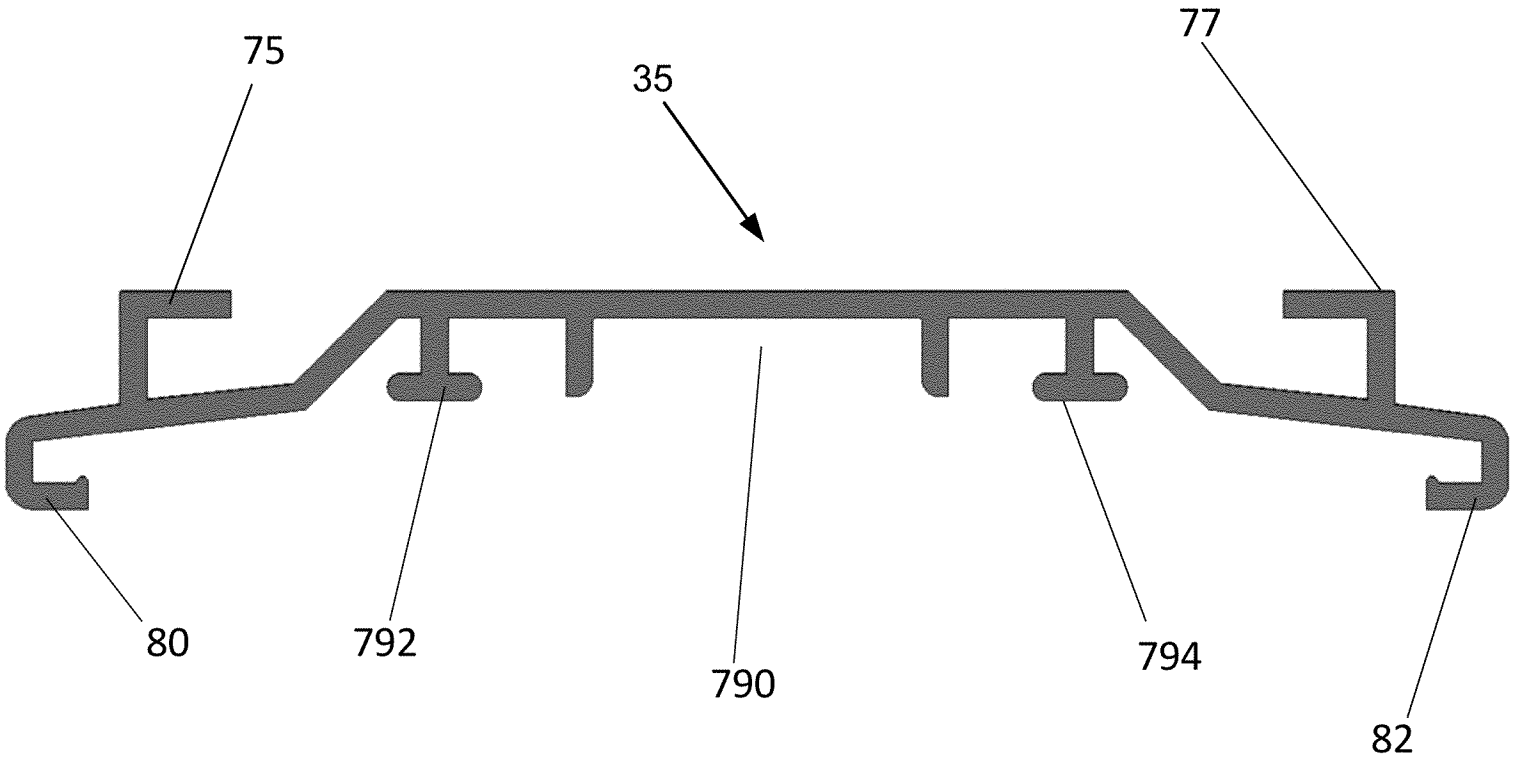
FIG. 21 is a cross section view of a rail according to one embodiment of the present invention.

With reference to FIG. 21, a rail 35 is shown according to another embodiment of the present invention. The rail 35 has notches 75 and 77 with a cavity 790 shown. The rail 35 also has support surfaces 80 and 82 as previously described under FIG. 3*b*. Positioning protrusions 792 and 794 are present on the rail 35 as such positioning protrusions correspond to the positioning members (not shown) of the front retainer (not shown) described under FIG. 16 for example.

A worker skilled in the relevant art would be familiar with various shapes the positioning protrusions could include allowing for ease of installation of a front retainer to a rail under a dispenser of the present invention without being outside the scope of the present invention.

Although the invention has been described above by reference to certain embodiments of the invention, the invention is not limited to the embodiments described above. Modifications and variations of the embodiments described above will occur to those skilled in the art in light of the above teachings. Moreover, with respect to the above description, it is to be understood that the optimum dimensional relationships for the component members of the present invention may include variations in size, material, shape, form, funding and manner of operation.

What is claimed is:

1. A dispenser for at least one container, each of the at least one container having a lip, the dispenser comprising:

a rail for slidably engaging the lip of the container, said rail comprising support surfaces for engaging said lip of the container;

a front retainer for retaining the container, the front retainer operatively coupled and aligned to the support surfaces of the rail, the front retainer comprising: (i) first and second hooks such that the container slides from the support surfaces of the rail onto the first and second hooks of the front retainer; and (ii) first and second positioning members further comprised of abutment protrusions providing a distance therebetween, said distance being narrower than the diameter of the container such that the abutment protrusions hold the container in the front retainer by exerting inwards pressure onto said container;

a pusher operatively coupled to the rail; and a back cap operatively coupled to the rail, wherein the pusher slides along the rail to push each of the at least one container forward toward the front retainer.

2. The dispenser of claim 1, wherein the rail has a cavity.

3. The dispenser of claim 1, wherein the rail has first and second notches for installing in a unit.

4. The dispenser of claim 1, wherein the pusher has a front panel which contacts with the at least one container.

5. The dispenser of claim 1, wherein the pusher has a neck to be operatively coupled to the rail.

6. The dispenser of claim 1, wherein the pusher has a hollow housing having a coil for displacing the pusher towards the front retainer to move the at least one container such that they abut the front retainer.

* * * * *